US008565627B2

(12) United States Patent
Kinukawa et al.

(10) Patent No.: US 8,565,627 B2
(45) **Date of Patent: *Oct. 22, 2013**

(54) IMAGE FORMING APPARATUS AND CONTROL METHOD THEREOF

(75) Inventors: Tatsuya Kinukawa, Mishima (JP); Hitoshi Furukawa, Suntou-gun (JP); Takao Kume, Yokohama (JP); Kazuhiro Funatani, Mishima (JP); Masahide Hirai, Numazu (JP); Yoshiro Saito, Susono (JP); Tomoaki Nakai, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 924 days.

This patent is subject to a terminal disclaimer.

(21) Appl. No.: 12/470,608

(22) Filed: May 22, 2009

(65) Prior Publication Data

US 2009/0296147 A1 Dec. 3, 2009

(30) Foreign Application Priority Data

May 27, 2008 (JP) ..... 2008-138780
Apr. 21, 2009 (JP) ..... 2009-103362

(51) Int. Cl.
*G03G 15/00* (2006.01)

(52) U.S. Cl.
USPC ..... 399/49; 399/301; 399/302

(58) Field of Classification Search
USPC ..... 399/49, 9, 301, 394, 302; 358/1.7, 1.15
See application file for complete search history.

(56) References Cited

U.S. PATENT DOCUMENTS

| | | | | |
|---|---|---|---|---|
| 5,499,092 | A | 3/1996 | Sasaki | |
| 6,493,533 | B1 | 12/2002 | Munakata | |
| 6,658,221 | B2 | 12/2003 | Hama et al. | 399/49 |
| 6,909,858 | B2 | 6/2005 | Hama et al. | |
| 6,985,678 | B2 | 1/2006 | Maebashi et al. | |
| 7,058,323 | B2 | 6/2006 | Maeyama et al. | |
| 7,072,597 | B2 | 7/2006 | Shimura et al. | |
| 7,535,580 | B2 | 5/2009 | Matsuoka | |
| 7,953,334 | B2 | 5/2011 | Shida | |
| 8,175,474 | B2 | 5/2012 | Kinukawa et al. | |

(Continued)

FOREIGN PATENT DOCUMENTS

| | | |
|---|---|---|
| CN | 1083646 A | 3/1994 |
| JP | 2-297006 A | 12/1990 |

(Continued)

OTHER PUBLICATIONS

Notification of the First Office Action dated Mar. 2, 2011, in counterpart Chinese Application No. 200910145658.0.

(Continued)

*Primary Examiner* — Sophia S Chen
(74) *Attorney, Agent, or Firm* — Fitzpatrick, Cella, Harper & Scinto

(57) ABSTRACT

There is provided an image forming apparatus which shortens the time taken for circumference detection and measures the circumference at high precision without obstructing downsizing of the apparatus. To accomplish this, the image forming apparatus detects, at an arbitrary timing, the physical pattern of the image-formed surface of a rotation member that changes over time. In the second round, the image forming apparatus detects the second pattern at a timing a predetermined time after the arbitrary timing. By using the detected patterns, the image forming apparatus obtains information associated with the circumference of the rotation member.

25 Claims, 23 Drawing Sheets

(56) References Cited

U.S. PATENT DOCUMENTS

| | | | | |
|---|---|---|---|---|
| 8,185,003 | B2 * | 5/2012 | Hirai et al. | 399/49 |
| 8,264,733 | B2 | 9/2012 | Hanashi et al. | |
| 2004/0105691 | A1 | 6/2004 | Hama et al. | |
| 2005/0286918 | A1 | 12/2005 | Maeyama et al. | |
| 2007/0036568 | A1 | 2/2007 | Shida | |
| 2007/0231021 | A1 | 10/2007 | Kinoshita et al. | 399/301 |
| 2007/0237533 | A1 | 10/2007 | Hanashi et al. | 399/49 |
| 2007/0247636 | A1 | 10/2007 | Matsuoka | |
| 2009/0296147 | A1 | 12/2009 | Kinukawa et al. | |
| 2009/0297190 | A1 | 12/2009 | Kinukawa et al. | |
| 2009/0297191 | A1 | 12/2009 | Hirai et al. | |
| 2012/0195605 | A1 | 8/2012 | Hirai et al. | |

FOREIGN PATENT DOCUMENTS

| | | | |
|---|---|---|---|
| JP | 5-215532 | A | 8/1993 |
| JP | 10-164003 | A | 6/1998 |
| JP | 10-288880 | A | 10/1998 |
| JP | 11-038707 | A | 2/1999 |
| JP | 2000-162833 | A | 6/2000 |
| JP | 2002-214854 | A | 7/2002 |
| JP | 2004-85711 | A | 3/2004 |
| JP | 2005-148299 | A | 6/2005 |
| JP | 2005-189494 | A | 7/2005 |
| JP | 2006-10826 | A | 1/2006 |
| JP | 2006-15062 | A | 1/2006 |
| JP | 2006-126448 | A | 5/2006 |
| JP | 2006-150627 | A | 6/2006 |
| JP | 2007-279523 | A | 10/2007 |
| JP | 2007-283721 | A | 11/2007 |
| JP | 2009-288351 | A | 12/2009 |
| JP | 2010-8804 | A | 1/2010 |
| JP | 2010-9018 | A | 1/2010 |
| JP | 2010-26102 | A | 2/2010 |
| JP | 2010-39126 | A | 2/2010 |

OTHER PUBLICATIONS

Communication dated Aug. 14, 2009, forwarding a Search Report in counterpart European Application No. 09158797.2-1240.

Notification of Reasons for Refusal issued Oct. 12, 2012, in Japanese Application No. 2008-138782.

* cited by examiner

IMAGE FORMING APPARATUS AND CONTROL METHOD THEREOF

BACKGROUND OF THE INVENTION

1. Field of the Invention

The present invention relates to an image forming apparatus such as a copying machine, printer, or facsimile apparatus which forms an image by an electrophotographic method.

2. Description of the Related Art

These days, image forming apparatuses using the electrophotographic method are achieving higher speeds and higher qualities. In particular, color image forming apparatuses require accurate color reproduction and tint stability, and generally have a function of automatically controlling the image density.

In image density calibration control, an image density detector incorporated in an image forming apparatus detects a plurality of test toner images (patches) which are formed on an image carrier while changing image forming conditions. The detected toner images are converted into a substantial amount of toner adhesion, and optimum image forming conditions are determined based on the conversion result.

A plurality of types of image density calibration control operations is generally executed to obtain optimum values for a plurality of types of image forming conditions. The types of image forming conditions include conditions such as the charging voltage, exposure intensity, and developing voltage, and a lookup table setting used to convert a signal input from the host into output image data when forming a halftone image. The tint varies depending on a change of the environment where an image forming apparatus is used, the use log of various consumables, and the like. The image density calibration control needs to be periodically executed to always stabilize the tint.

According to the detection principle of an optical image density detector, a light receiving element receives light which is emitted from a light emitting element and reflected by a patch or image carrier itself. The amount of toner adhered to the patch is calculated from the received light. Conversion into a substantial amount of toner adhesion is executed based on the relationship between an output from the light receiving element when no toner is adhered to the image carrier, and an output from the light receiving element when toner is adhered to the image carrier.

The reflectance of the image carrier surface changes depending on the position of the image carrier. To calculate the amount of toner adhesion with high precision, outputs in the presence and absence of toner need to be acquired at the same position on the image carrier. In general, a background output VB from the light receiving element in the absence of toner is acquired at a specific position. Then, the image carrier rotates at least one round. A patch is formed at the same position to acquire a patch output VP from the light receiving element. The background output VB corresponds to light reflected by the background of the image carrier. The patch output VP corresponds to light reflected by the patch. Specifying the position on the image carrier requires the circumference of the image carrier. This is because the time taken for a specific position on the image carrier to rotate is obtained by dividing the circumference by the circumferential speed (process speed) of the image carrier.

However, the circumference of the image carrier changes depending on variations of components, the environment of the image forming apparatus, and the like. If the circumference is used as a fixed value, an error occurs in specifying a position. To prevent this, information associated with the circumference of the image carrier needs to be measured dynamically.

Japanese Patent Laid-Open No. 10-288880 proposes the following method for an image forming apparatus which employs an intermediate transfer method. More specifically, a mark is attached to the surface of an intermediate transfer member. An optical sensor receives light reflected by the mark to measure the circumference of an image carrier. The mark is attached not to an image-formed surface used for image formation, but to a longitudinal end on the intermediate transfer member.

Japanese Patent Laid-Open No. 2006-150627 proposes a method of measuring the circumference of an electrostatic attraction belt in an image forming apparatus which adopts a direct transfer method. More specifically, according to the method disclosed in Japanese Patent Laid-Open No. 2006-150627, a patch is formed immediately below an optical image density detector. The optical image density detector measures the circumference of a target electrostatic attraction belt.

However, the conventional techniques suffer the following problems. For example, in the image forming apparatus in Japanese Patent Laid-Open No. 10-288880 that adopts the intermediate transfer method, the intermediate transfer member needs to rotate up to the mark set position, and further rotate one round. This is because when measurement of the circumference starts, the mark is not always positioned near the optical sensor. In the worst case, no circumference can be detected unless the intermediate transfer member rotates almost two rounds. A long circumference measurement time prolongs the period (so-called downtime) during which no image can be formed, impairing usability.

Even if usability can be maintained, the cost rises owing to an optical detection mark and optical sensor for measuring the circumference of an intermediate transfer member, as described above.

The image forming apparatus disclosed in Japanese Patent Laid-Open No. 2006-150627 forms a circumference measurement patch, consuming a larger amount of toner, compared to a case wherein no patch is formed. For the user, it is desirable to save toner as much as possible. In some cases, cleaning may take a long time.

SUMMARY OF THE INVENTION

The present invention enables realization of an image forming apparatus which shortens the time taken for circumference detection, reduces the amount of toner used, and measures the circumference or detects an accurate density.

One aspect of the present invention provides an image forming apparatus having a rotation member which is used for image formation or carrying a printing material, and a detector which detects light coming from the rotation member, the apparatus comprising: a first acquisition unit that acquires first waveform data of a surface of the rotation member based on detection by the detector; a second acquisition unit that acquires second waveform data of the surface of the rotation member based on detection by the detector, the second waveform data being detected from at least part of a detected section of the surface of the rotation member on which the first waveform data has been detected; and a calculator that calculates information associated with a circumference of the rotation member based on matching between the acquired first waveform data and second waveform data.

Another aspect of the present invention provides an image forming apparatus having a rotation member which is used for image formation or carrying a printing material, a detector which detects light coming from the rotation member, and a patch forming unit that forms a patch on the rotation member, the detector detecting reflected light upon irradiating the patch with light, the apparatus comprising: a first acquisition unit that acquires first waveform data of a surface of the rotation member based on detection by the detector; and a second acquisition unit that acquires second waveform data of the surface of the rotation member based on detection by the detector, the second waveform data being detected from at least part of a detected section of the surface of the rotation member on which the first waveform data has been detected, wherein density is detected based on matching between the acquired first waveform data and second waveform data, and the reflected light detected by the detector.

Still another aspect of the present invention provides a method of controlling an image forming apparatus having a rotation member which is used for image formation or carrying a printing material, and a detector which detects light coming from the rotation member, the method comprising: acquiring first waveform data of a surface of the rotation member based on detection by the detector; acquiring second waveform data of the surface of the rotation member based on detection by the detector, the second waveform data being detected from at least part of a detected section of the surface of the rotation member on which the first waveform data has been detected; and calculating information associated with a circumference of the rotation member based on matching between the acquired first waveform data and second waveform data.

Yet another aspect of the present invention provides a method of controlling an image forming apparatus having a rotation member which is used for image formation or carrying a printing material, a detector which detects light coming from the rotation member, and a patch forming unit that forms a patch on the rotation member, the detector detecting reflected light when the patch is irradiated with light, the method comprising: acquiring first waveform data of a surface of the rotation member based on detection by the detector; and acquiring second waveform data of the surface of the rotation member based on detection by the detector, the second waveform data being detected from at least part of a detected section of the surface of the rotation member on which the first waveform data has been detected, wherein density is detected based on matching between the acquired first waveform data and second waveform data, and the reflected light detected by the detector.

Further features of the present invention will be apparent from the following description of exemplary embodiments with reference to the attached drawings.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

<First Embodiment>

The first embodiment will be explained with reference to FIGS. 1 to 15. In the first embodiment, the present invention is applied to a color image forming apparatus. The present invention is also applicable to a monochrome image forming apparatus. The image forming apparatus is, for example, a printer, copying machine, multi-functional peripheral, or facsimile apparatus. The first embodiment will exemplify an intermediate transfer method. The intermediate transfer method forms a toner image on a drum-like image carrier, preliminarily transfers the toner image to an intermediate transfer member (intermediate transfer belt), and secondarily transfers the toner image from the intermediate transfer member to a printing material. The printing material is also called, for example, a transfer material, printing medium, paper, sheet, or transfer paper.

[Image Forming Apparatus System]

Figure 1:
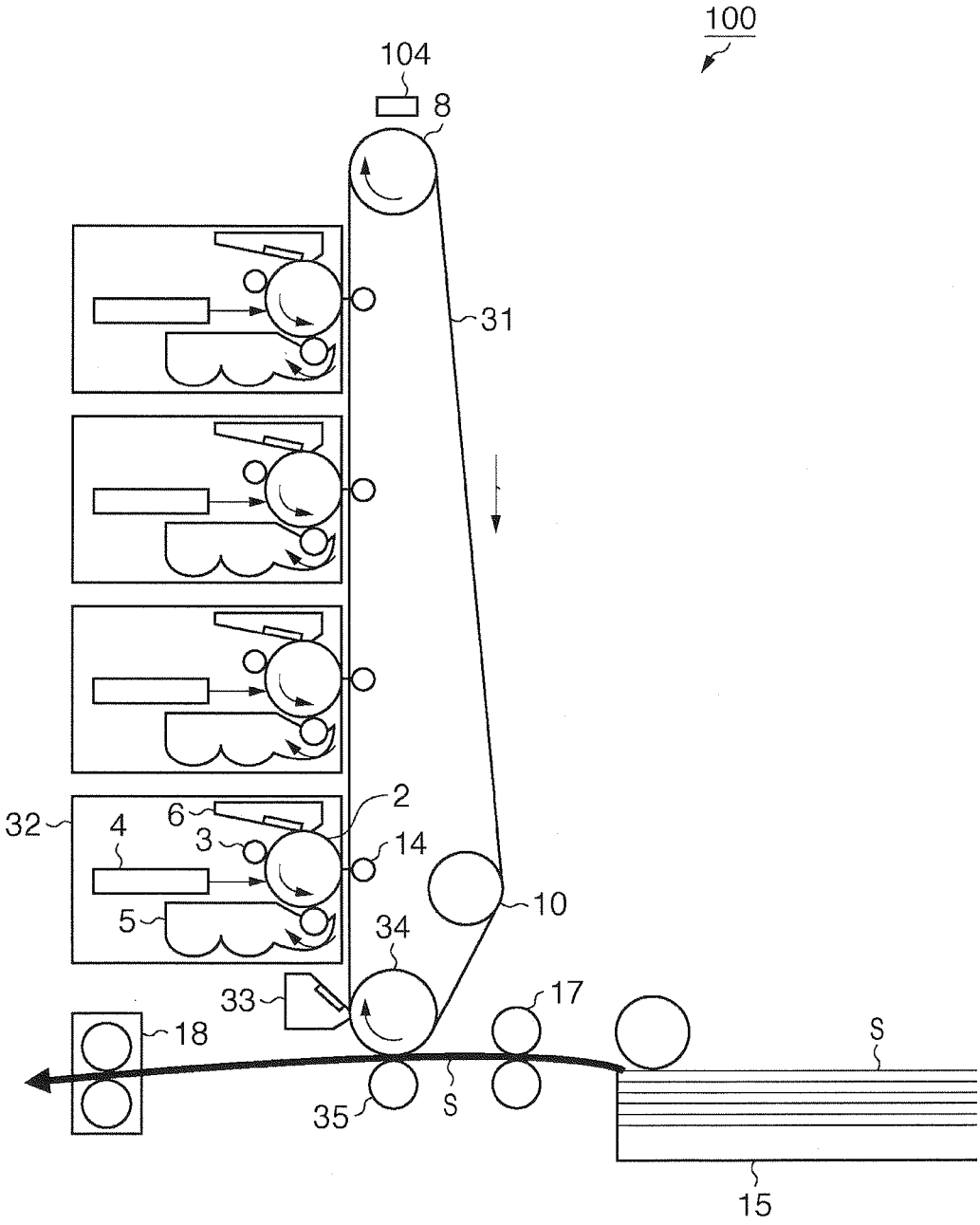
FIG. 1 is a schematic sectional view of a color image forming apparatus according to the first embodiment.

FIG. 1 is a schematic sectional view of a color image forming apparatus according to the first embodiment. The color image forming apparatus includes four image forming stations corresponding to Y (Yellow), M (Magenta), C (Cyan), and Bk (Black) toners. For descriptive convenience, the image forming stations have a common arrangement except for the color of the developer (toner).

Each process cartridge 32 includes a photosensitive drum 2, charger 3, exposure unit 4, developing unit 5, and cleaning blade 6. Toner images of different colors formed by the process cartridges (image forming stations) 32 are primarily transferred in series onto an intermediate transfer belt 31 by primary transfer rollers 14. The intermediate transfer belt 31 is an example of a rotation member used for image formation. A secondary transfer roller 35 secondarily transfers, onto a printing material S, a multicolor image formed on the intermediate transfer belt 31. The printing material S is conveyed from a paper feed unit 15. Then, a fixing unit 18 fixes the multicolor image onto the printing material S. A cleaner 33 recovers toner left on the intermediate transfer belt 31.

The photosensitive drum 2 is a rotary drum type electrophotographic photosensitive body used repetitively. The photosensitive drum 2 is driven to rotate at a predetermined circumferential speed (process speed). The process speed is, for example, 180 mm/sec. The primary charging roller of the primary charger 3 uniformly charges the photosensitive drum 2 to a predetermined polarity and potential. The exposure unit 4 includes a laser diode, polygon scanner, lens unit, and the like. The exposure unit 4 exposes the photosensitive drum 2 to an image, forming an electrostatic latent image on the photosensitive drum 2.

The developing unit 5 executes developing processing to adhere toner to an electrostatic latent image formed on the image carrier. The developing roller of the developing unit 5 is arranged in contact with the photosensitive drum 2 while rotating in the forward direction with respect to the photosensitive drum 2.

A driving roller 8 drives the intermediate transfer belt 31 to rotate in contact with the respective photosensitive drums 2 at almost the same circumferential speed as that of the photosensitive drums 2. The intermediate transfer belt 31 is formed from, for example, an endless film member about 50 to 150 μm thick at a volume resistivity of, for example, 10E8 to 10E12 Ωcm. For example, an image-formed surface (to be referred to as a surface hereinafter) used for image formation on the intermediate transfer belt 31 has a relatively high reflectance for black. The intermediate transfer belt 31 expands and contracts in accordance with the tolerance (about ±1.0 mm with respect to an ideal dimension value) in manufacturing the belt, and variations dependent on the temperature and humidity of the use environment (the intermediate transfer belt 31 varies by about 5 mm in an environment of 15° C. and 10% to that of 30° C. and 80%). However, a tension roller 10 keeps the intermediate transfer belt 31 taut, so the intermediate transfer belt 31 can rotate normally even if the circumference varies.

The primary transfer roller 14 is a solid rubber roller whose resistance is adjusted to 10E7 to 10E9Ω. The cleaning blade 6 removes and recovers toner left on the photosensitive drum 2 after primary transfer.

The printing material S fed from the paper feed unit 15 is conveyed toward the nip between the intermediate transfer belt 31 and the secondary transfer roller 35 by a pair of registration rollers 17 driven to rotate at a predetermined timing. A toner image on the intermediate transfer belt 31 is transferred to the printing material S by the action of static electricity generated by a high voltage applied to the secondary transfer roller 35.

[Control Arrangement of Image Forming Apparatus]

Figure 2:
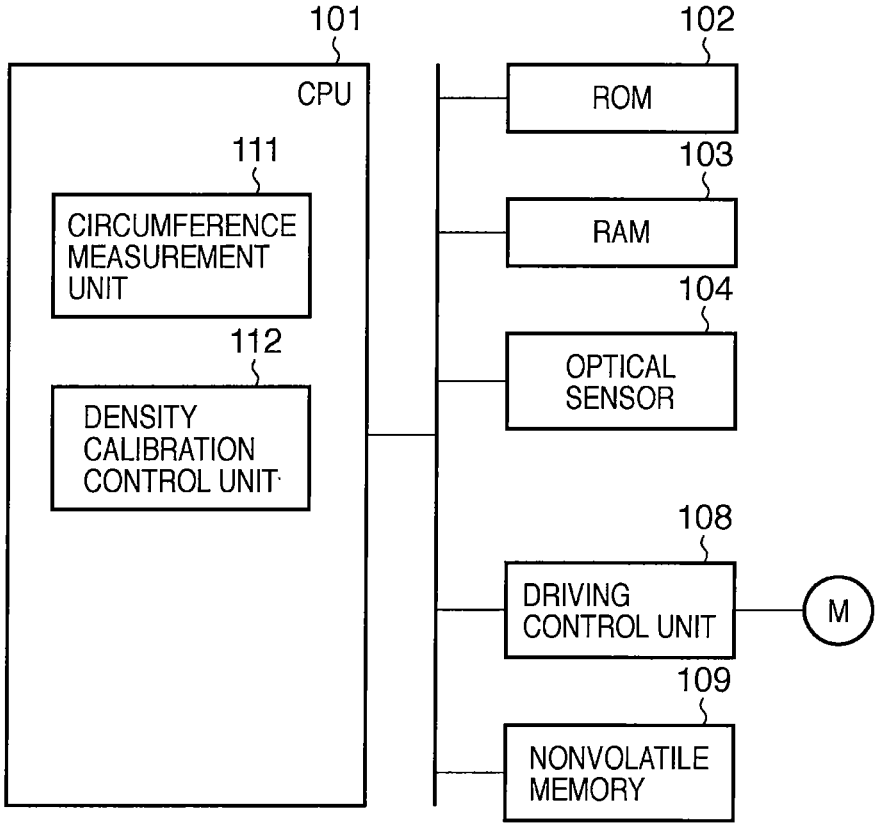
FIG. 2 is a block diagram showing an example of a control unit according to the first embodiment.

FIG. 2 is a block diagram showing an example of a control unit according to the first embodiment. A CPU 101 controls each unit of the image forming apparatus based on a variety of control programs stored in a ROM 102 by using a RAM 103 as a work area. The ROM 102 stores various control programs, various data, tables, and the like. The RAM 103 provides a program loading area, a work area for the CPU 101, various data storage areas, and the like. As characteristic functions, the CPU 101 in FIG. 2 includes a circumference measurement unit 111 and density calibration control unit 112.

A driving control unit 108 controls motors for driving the photosensitive drum 2, charger 3, exposure unit 4, developing unit 5, and intermediate transfer belt 31, and the charging bias, developing bias, and the like in accordance with instructions from the CPU 101.

A nonvolatile memory 109 is a storage which saves a variety of data such as light quantity setting data and information associated with the circumference of the intermediate transfer belt 31 which are used to execute image density calibration control.

The circumference measurement unit 111 measures the circumference of the intermediate transfer belt 31 based on data acquired by an optical sensor 104 from the intermediate transfer belt 31. The circumference measurement unit 111 is an example of a calculator which calculates information associated with the actual circumference of a rotation member. Information associated with the actual circumference means information for graphing the circumference of a rotation member that varies owing to any cause. This information is necessary to specify/detect, after a certain time, the same position as a given position at a given timing while the rotation member rotates. An example of this information is a length ($X_{profile\ result}$ to be described later) by which the rotation member expands or contracts over time from the nominal circumference (ideal dimension value free from any manufacturing tolerance or environmental variations) of the rotation member. Another example is actual circumference information (actual circumference given by equation (3) to be described later) of one round of the rotation member. The entity of the information may also be digital data (count value) representing the time, or digital data (count value) representing the length.

The density calibration control unit 112 adjusts image forming conditions using the quantity of light reflected by a patch image that is acquired using the optical sensor 104 for density calibration control, and obtained information associated with the actual circumference of the intermediate transfer belt 31.

The first embodiment will exemplify a case wherein the CPU 101 executes circumference measurement and density calibration control. However, the present invention is not limited to this. For example, when an image forming apparatus incorporates an ASIC (Application Specific Integrated Circuit) or SOC (System On Chip), the ASIC or SOC may also execute part or all of circumference measurement processing and density calibration control processing. The SOC is a chip which integrates a CPU and ASIC into a single package. When the ASIC executes circumference measurement and density calibration control, this can reduce the processing load on the CPU 101.

[Optical Sensor]

Figure 3:
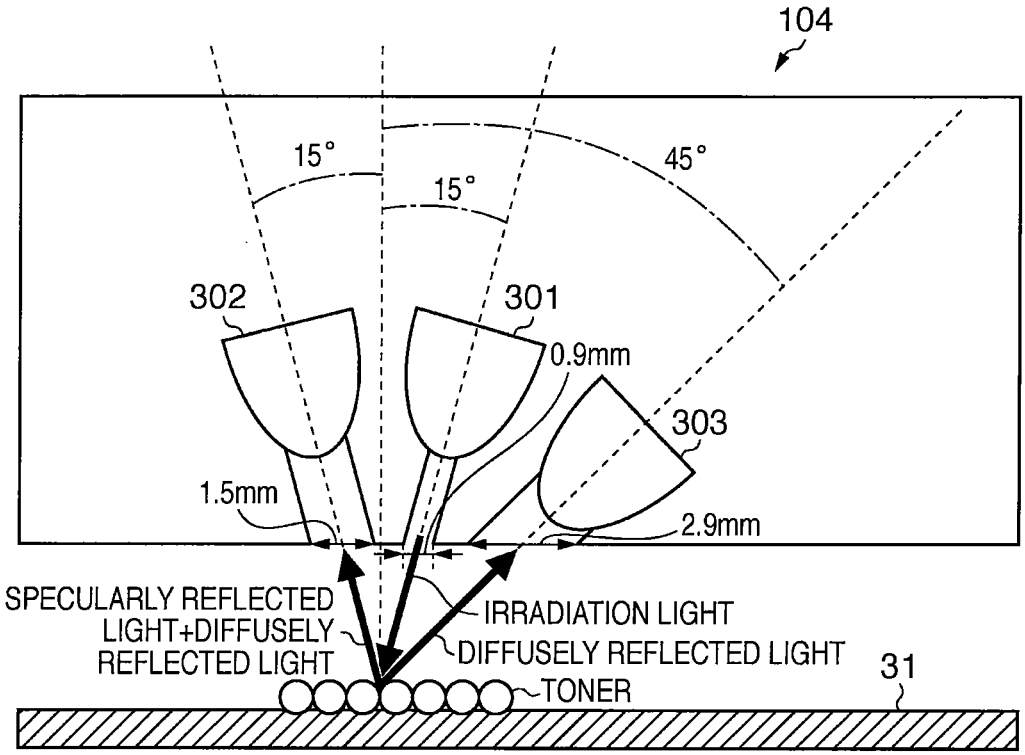
FIG. 3 is a view showing an example of an optical sensor 104.

FIG. 3 is a view showing an example of the optical sensor 104. The optical sensor 104 includes a light emitting element 301 such as an LED, two light receiving elements 302 and 303 such as photodiodes, and a holder. For example, the light emitting element 301 emits infrared light (wavelength: 950 nm) to a patch on the intermediate transfer belt 31 or the background. The light receiving elements 302 and 303 measure the quantity of light reflected by the patch or background. The density calibration control unit 112 of the CPU 101 calculates the amount of toner adhesion based on the reflected light quantity obtained by the optical sensor 104.

Light reflected by the patch or background contains a specularly reflected component and diffusely reflected component. The light receiving element 302 detects both specularly and diffusely reflected components. The light receiving element 303 detects only a diffusely reflected component. When toner adheres to the intermediate transfer belt 31, it cuts off light, decreasing specularly reflected light. That is, an output from the light receiving element 302 decreases.

A black toner absorbs 950 nm infrared light used in the embodiment, and yellow, magenta, and cyan toners diffusely reflect it. Hence, a larger amount of toner adhesion to the intermediate transfer belt 31 increases an output from the light receiving element 303 as for yellow, magenta, and cyan toners. The light receiving element 302 is also influenced by a large amount of toner adhesion. That is, even when yellow, magenta, and cyan toners completely shield the intermediate transfer belt 31 from light, an output from the light receiving element 302 still remains.

The first embodiment sets the irradiation angle of the light emitting element 301 to 150, the light receiving angle of the light receiving element 302 to 150, and that of the light receiving element 303 to 450. These angles define optical axes with respect to the perpendicular of the intermediate transfer belt 31. The aperture diameter of the light receiving element 302 is set smaller than that of the light receiving element 303 in order to minimize the influence of the diffusely reflected component. For example, the aperture diameter of the light emitting element 301 is 0.9 mm, that of the light receiving element 302 is 1.5 mm, and that of the light receiving element 303 is 2.9 mm. The aperture diameter of the light emitting element 301 is set small to place importance on detection accuracy of a positional shift detection mark when the light emitting element 301 is shared between detection of a density calibration control patch image and detection of a positional shift detection mark. When detecting reflected one of light emitted from the light emitting element 301, even a relatively local density variation can be detected at high sensitivity.

A typical example of the optical sensor 104 has been described. However, it will readily occur to those skilled in the art that the optical sensor 104 can be implemented by various well-known types of sensors such as one using infrared light as irradiation light.

[Necessity of Image Density Calibration Control]

In an image forming apparatus 100, the optical sensor 104 serving as an optical detector is arranged to face the intermediate transfer belt 31. Generally in an electrophotographic color image forming apparatus, the electrical characteristics of each unit and printing material, and the attraction force to toner change under various conditions such as exchange of consumables, change of the environment (e.g., change of the temperature or humidity, or degradation of the apparatus), and the number of printed sheets. A change of the characteristics appears as variations of the image density or a change of color reproduction. Such variations obstruct obtaining accurate original color reproduction.

In the first embodiment, to always obtain accurate color reproduction, a plurality of patches (toner images) are formed as test images while changing image forming conditions in a no-image forming state. The optical sensor 104 detects the densities of these patches. The no-image forming state means a state in which a general document or the like created by a user is not formed. Based on the detection result, the density calibration control unit 112 executes image density calibration control. Factors which influence the image density are the charging bias, developing bias, exposure intensity, lookup table, and the like. The first embodiment will exemplify a case wherein image forming conditions are adjusted by correcting a lookup table. A concrete operation of image density calibration control will be described later.

[Necessity of Measuring Information Associated with Actual Circumference]

Figure 4:
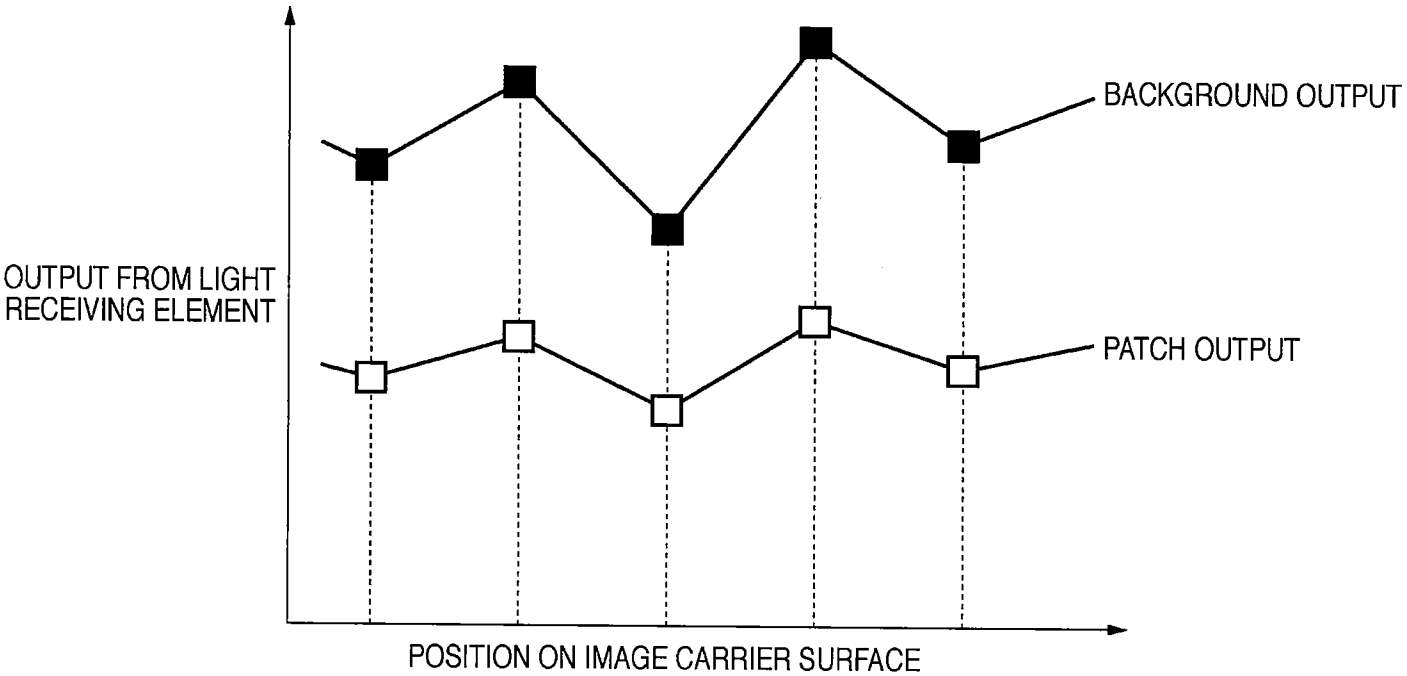
FIG. 4 is a graph exemplifying variations of background outputs and those of patch outputs at a plurality of positions on an intermediate transfer belt.

FIG. 4 is a graph exemplifying variations of background outputs and those of patch outputs at a plurality of positions on the intermediate transfer belt. Patches are toner images formed at the same halftone density. A background output represents a reflected light quantity detected by the light receiving element 302 when no patch is formed on the intermediate transfer belt. A patch output represents a reflected light quantity detected by the light receiving element 302 when a patch is formed on the intermediate transfer belt. As shown in FIG. 4, an output from the light receiving element 302 is influenced by the surface reflectance of the intermediate transfer belt 31 serving as an image carrier (rotation member) in the embodiment. For this reason, patch output values differ from each other though patches are formed at the same density. This also applies to the light receiving element 303.

If image density calibration control is executed under the influence of the reflectance of the background of the intermediate transfer belt 31, density data of a printed halftone image and outputs from the light receiving elements 302 and 303 have less correlation with each other. As a result, the precision of image density calibration control decreases. To cancel the influence of the reflectance of the surface of the intermediate transfer belt 31, it is necessary to measure reflected light beams received by the light receiving elements 302 and 303 in the presence and absence of toner at the same position on the intermediate transfer belt 31. A calculation method of canceling the influence of the reflectance of the surface (background) of the intermediate transfer belt 31 will be described later.

The circumference of the intermediate transfer belt 31 varies in accordance with the manufacturing tolerance, environment, and paper durability (long-term operation of the apparatus). To measure reflected light beams corresponding to the presence and absence of toner at the same position on the intermediate transfer belt 31, the circumference of the intermediate transfer belt 31 needs to be grasped accurately. The time taken for an arbitrary position to rotate one round can be calculated based on a circumference upon expansion/contraction or the expansion and contraction amount, and the process speed as long as a circumference upon expansion/contraction, or the amount by which the intermediate transfer belt expands or contracts can be measured. The calculated time taken for an arbitrary position to rotate one round corresponds to a cycle in which the arbitrary position on the intermediate transfer belt 31 passes through the detection point of the optical sensor 104. From this, when the timer measures the cycle of the intermediate transfer belt 31, the count value of the timer represents an absolute position on the intermediate transfer belt. A detailed mechanism of circumference measurement in the first embodiment will be described later. An arbitrary position in the first embodiment includes even a position where measurement starts when, for example, a plurality of measurement start timings are determined in advance and a measurement start timing closest to input of a measurement start instruction has come. The following description will use an "arbitrary position" and "arbitrary timing", which include the above-described meaning.

[Image Density Calibration Control]

A concrete example of image density calibration control in the first embodiment will be explained with reference to FIGS. 5 and 6. The CPU 101 executes the following processing by loading a control program stored in the ROM 102 into the RAM 103.

Figure 5:
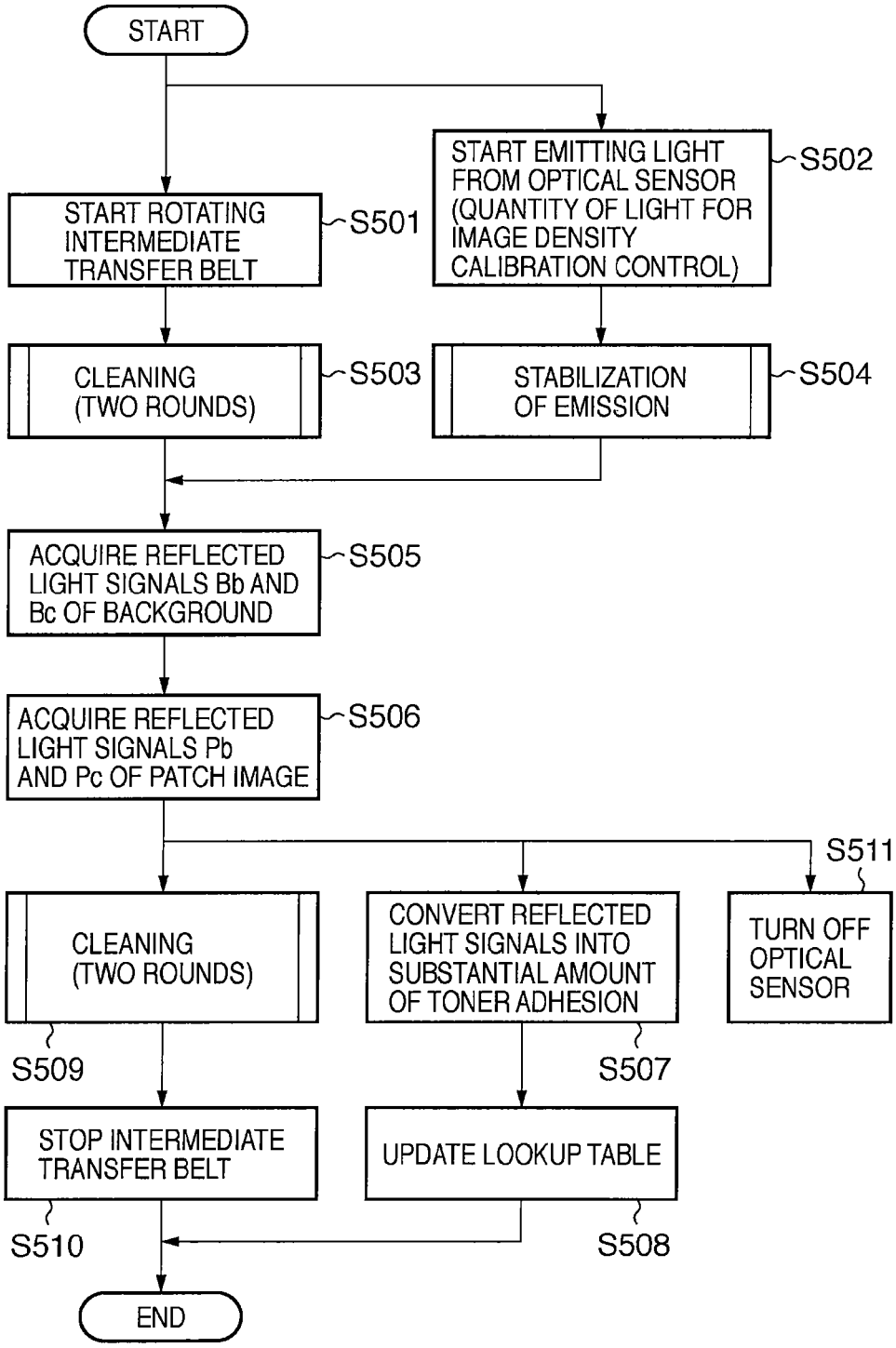
FIG. 5 is a flowchart showing an example of image density calibration control according to the first embodiment.

FIG. 5 is a flowchart showing an example of image density calibration control according to the first embodiment. In step S501, the density calibration control unit 112 starts rotating the intermediate transfer belt 31. In step S502 parallel to step S501, the density calibration control unit 112 causes the optical sensor 104 to emit light at a light quantity setting which is stored in the nonvolatile memory 109 and used to execute image density calibration control.

In step S503, the density calibration control unit 112 instructs the driving control unit 108 to make the intermediate transfer belt 31 rotate two rounds. The driving control unit 108 controls the driving motor of the intermediate transfer belt 31 to make the intermediate transfer belt 31 rotate two rounds. Then, the cleaner 33 removes toner adhered to the intermediate transfer belt 31. In step S504 parallel to step S503, the density calibration control unit 112 monitors output signals from the light receiving elements 302 and 303, and waits until emission of the optical sensor 104 stabilizes. After the density calibration control unit 112 confirms that the emission has stabilized, the process advances to step S505.

In step S505, the density calibration control unit 112 starts acquiring reflected light signals Bb and Bc from the light receiving elements 302 and 303 for light reflected by the intermediate transfer belt 31 itself (i.e., the background). The reflected light signal Bb corresponds to a background output from the light receiving element 302. The reflected light signal Bc corresponds to a background output from the light receiving element 303.

In step S506, the density calibration control unit 112 acquires reflected light signals Pb and Pc corresponding to the respective tones of low to high densities formed on the intermediate transfer belt 31. The reflected light signal Pb corresponds to a patch output from the light receiving element 302. The reflected light signal Pc corresponds to a patch output from the light receiving element 303. More specifically, the density calibration control unit 112 waits until the intermediate transfer belt 31 rotates one round more. After that, the density calibration control unit 112 controls each image forming station to form a patch image (FIG. 6) of each color. The reflected light signals Pb and Pc correspond to light beams reflected by the center of a patch image.

Figure 6:
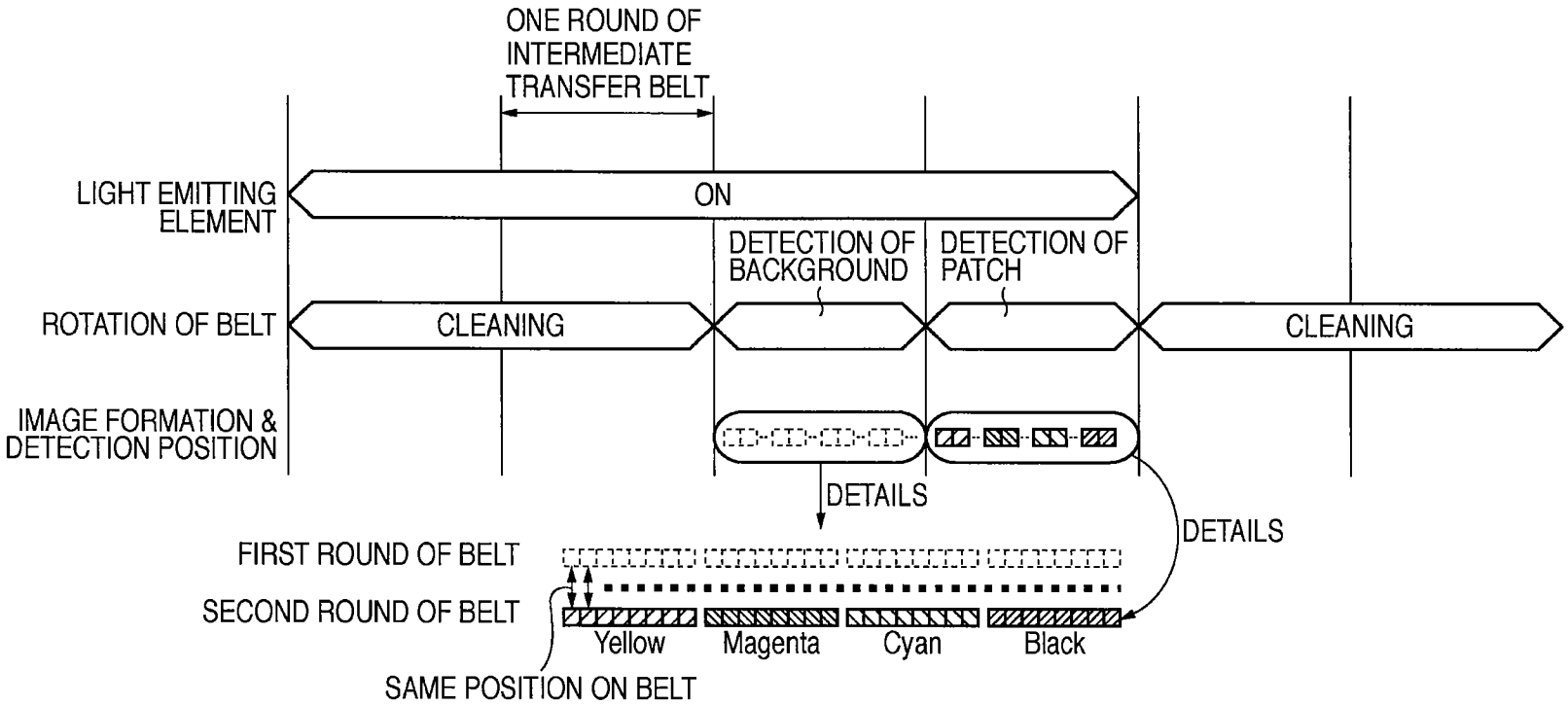
FIG. 6 is a timing chart showing an example of the emission timing, intermediate transfer belt rotation timing, and patch image formation timing.

FIG. 6 is a timing chart showing an example of the emission timing, intermediate transfer belt rotation timing, and patch image formation timing. Cleaning of the intermediate transfer belt is executed during the standby time until stabilization of the light emitting element. Then, a background output is detected, and a patch output is detected. Each image forming station forms patch images in a single color. However, patch images of each color have different densities (different image forming conditions).

In steps S505 and S506, the density calibration control unit 112 controls to acquire a background output and patch output at the same position on the intermediate transfer belt 31. This positional control is achieved by the above-described timing control using the circumference. More specifically, the density calibration control unit 112 acquires a patch output at a timing when a time corresponding to a circumference obtained by the circumference measurement unit 111 has elapsed after a timing when a background output at an arbitrary position was acquired. This can make a background output and patch output acquired at the same position correspond to each other. The timing need not be the time of a timepiece, and suffices to be the count value of a timer. In this manner, the density calibration control unit 112 and circumference measurement unit 111 function to specify a single position on the rotation member using information associated with the circumference of the rotation member.

Upon completion of acquiring all the reflected light signals Pb and Pc from the light receiving elements 302 and 303, the process advances to step S511. The density calibration control unit 112 turns off the light emitting element 301 of the optical sensor 104.

Figure 7:
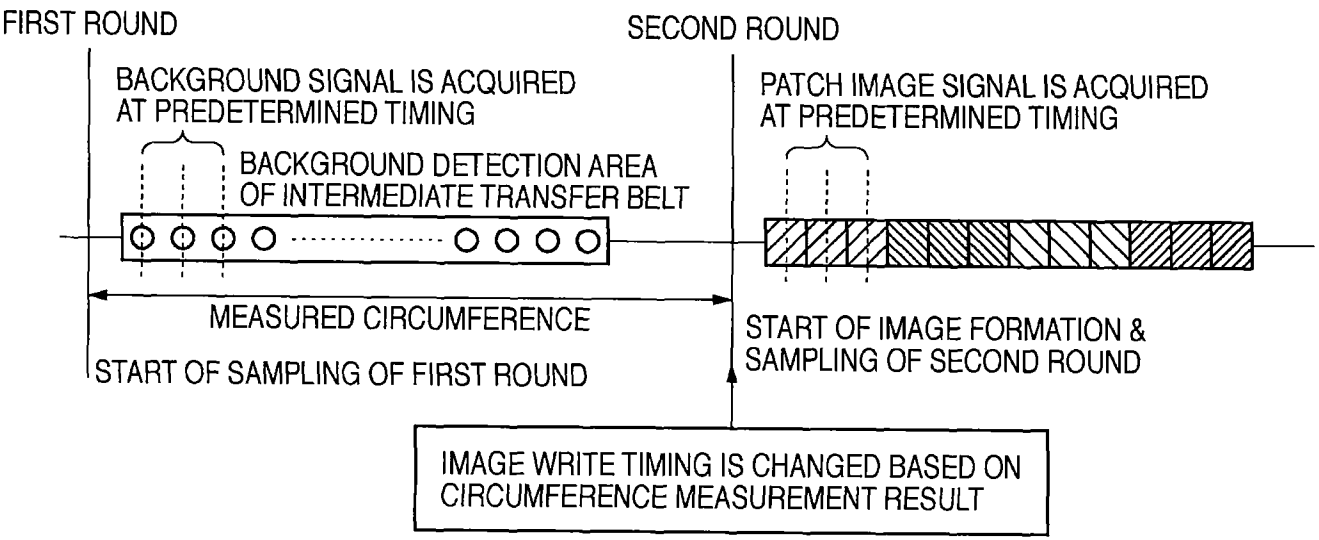
FIG. 7 is a timing chart for explaining sampling of the background density and patch image density.

The above-described steps S505 and S506 will be explained in detail with reference to FIG. 7. FIG. 7 is a timing chart for explaining sampling of the background density and patch image density. Image density calibration control according to the first embodiment adopts the following method to acquire signals representing light beams reflected by the background and a patch image at the same position on the intermediate transfer belt 31.

At the start of background sampling in the first round, the timer starts. By using the value (count value or time) of the activated timer as a reference, the background signal of the intermediate transfer belt 31 is sampled at a predetermined timing stored in advance in the ROM 102.

The time during which the intermediate transfer belt 31 rotates one round is monitored based on information associated with an actual circumference measured in circumference measurement. More specifically, when the time during which the intermediate transfer belt 31 rotates one round has elapsed after the start of background sampling in the first round, patch image formation and patch sampling in the second round start. Whether the time during which the intermediate transfer belt 31 rotates one round has elapsed can be determined by monitoring the value of the timer activated at the start of sampling. Sampling in the second round will be explained in more detail. For example, when a detected circumference measurement result is longer by 1.0 mm than a nominal value (ideal dimension value free from any manufacturing tolerance or environmental variations), a predetermined patch image write timing and sampling start timing are delayed by a time corresponding to 1.0 mm. This control can make the background position and patch position coincide with each other. Similar to sampling in the first round, sampling in the second round also uses the value (count value or time) of the activated timer as a reference. A patch image signal is acquired at a predetermined timing stored in the ROM 102.

As a feature of the present invention, when performing this image density calibration control, information for obtaining the circumference of the intermediate transfer belt 31 that requires an accurate value but may vary is acquired at low cost within a short downtime. This will be explained in detail later.

Referring back to FIG. 5, in step S507 parallel to step S511, the density calibration control unit 112 calculates the substantial amount of toner adhesion based on an acquired patch output serving as the detection result of a patch image corresponding to each tone, and a background output corresponding to the patch image. The substantial amount of toner adhesion is almost the reciprocal of the amount of toner adhered onto the intermediate transfer belt. As the conversion method, a variety of methods are available.

For example, the substantial amount of toner adhesion can be calculated using Bb, Bc, Pb, and Pc:

$$\text{substantial amount of toner adhesion}=(Pb-\alpha*(Pc-Bc))/Bb \quad (1)$$

where α is the constant. The constant α may also be stored in the ROM 102, RAM 103, or nonvolatile memory 109, or calculated from data stored in them. α may change for each model, and is determined by an experiment or simulation.

As described above, a smaller value of the substantial amount of toner adhesion increases the amount of toner adhesion in practice. This is because the quantity of reflected light decreases at high toner density. Bb serving as the denominator of equation (1) means net specularly reflected light (obtained by subtracting a diffusely reflected component) received by the light receiving element 302 upon irradiating a patch image with light. By using a table (FIG. 8) stored in the ROM 102, the substantial amount of toner adhesion can be further converted into an amount of toner adhesion or an actual image density upon actually printing on paper.

Figure 8:
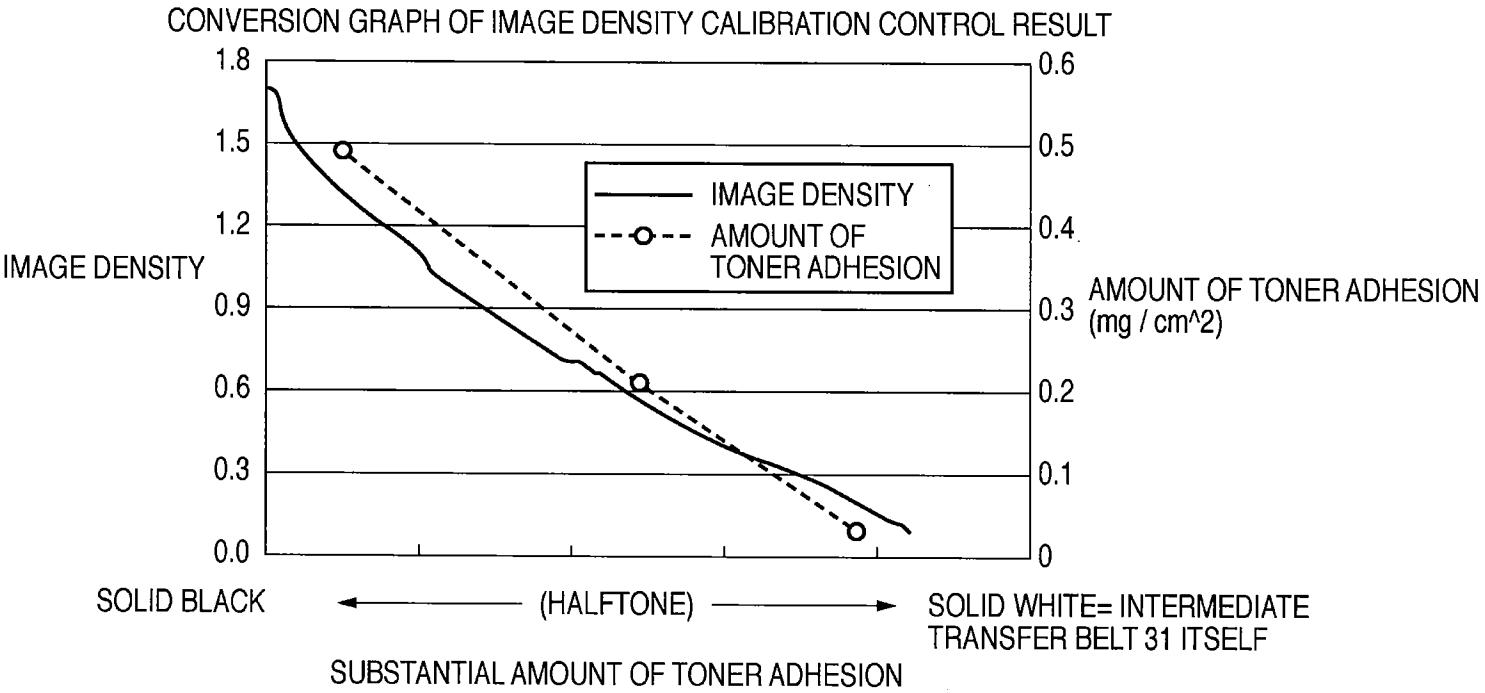
FIG. 8 is a graph showing an example of a table which holds the relationship between the substantial amount of toner adhesion, the image density, and the amount of toner adhesion.

FIG. 8 is a graph showing an example of a table which holds the relationship between the substantial amount of toner adhesion and the image density, and that between the substantial amount of toner adhesion and the amount of toner adhesion. Use of this table allows further conversion of a calculated substantial amount of toner adhesion into an amount of toner adhesion or an image density.

In step S508, the density calibration control unit 112 updates the lookup table so that the result of converting the detection result of each tone of each color into a substantial amount of toner adhesion, amount of toner adhesion, or image density corresponds to an original tone. By updating the lookup table, an image can be formed on a printing material at a set image density.

In this way, the density calibration control unit 112 is an example of a unit which controls the density of a formed image based on each background data and each patch detection result. Each background data is data of light reflected by the background of the rotation member throughout the circumference of the rotation member that starts from an arbitrary position on the rotation member. Each patch detection result is data of light reflected by a patch formed with toner in another round at the same position as the position where each background data has been acquired.

In step S509 parallel to step S507, the density calibration control unit 112 instructs the driving control unit 108 to clean a patch image formed on the intermediate transfer belt 31. This cleaning is done in two rounds of the intermediate transfer belt 31. Upon completion of cleaning, in step S510, the density calibration control unit 112 instructs the driving control unit 108 to stop the rotation of the intermediate transfer belt 31.

[Details of Circumference Measurement Method]

The circumference measurement (calculation) method in the first embodiment will be explained in detail. In the first embodiment, the circumference measurement target is the intermediate transfer belt 31 serving as an example of the rotation member. The circumference of the intermediate transfer belt 31 may be measured using the optical sensor 104 which is also used in image density calibration control. The use of the optical sensor 104 can decrease the number of sensors. In the first embodiment, a plurality of waveform data on the image-formed surface of the intermediate transfer belt 31 are detected to obtain information associated with the actual circumference of the intermediate transfer belt 31 by using detected patterns, which will be described later.

The optical sensor 104 according to the first embodiment employs an LED as a light emitting unit. Light emitted from the LED is incoherent light, unlike a laser or the like which emits coherent light. Coherent light has a uniform wavelength and phase, and allows measuring a speckle pattern obtained upon reflection by an object. For example, coherent light is used to observe the roughness of the object surface. A laser or the like which emits coherent light is generally expensive, and increases the cost of the product. In general, an image sensor is used to measure the speckle pattern. The image sensor is more expensive than a light receiving element such as a photodiode. Hence, an LED lower in cost than a laser or the like is advantageous for measuring the circumference of the intermediate transfer belt 31.

Figure 9:
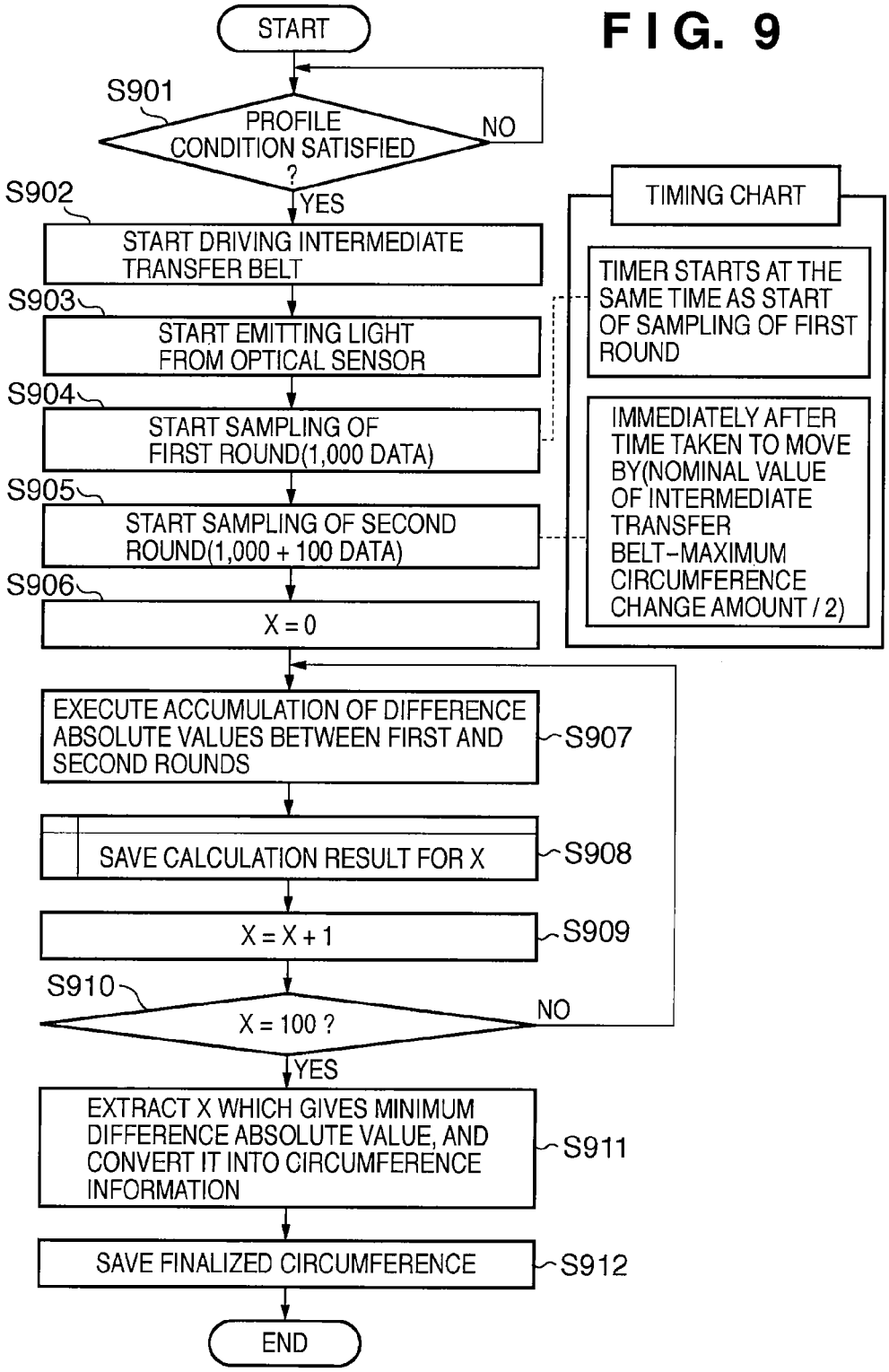
FIG. 9 is a flowchart showing processing to obtain information associated with the actual circumference of the intermediate transfer belt according to the first embodiment.

FIG. 9 is a flowchart showing processing to cause the CPU 101 to acquire two waveform data and obtain information associated with the actual circumference of the intermediate transfer belt based on matching between the two waveform data in the first embodiment. The CPU 101 executes the following processing by loading a control program stored in the ROM 102 into the RAM 103.

In step S901, the circumference measurement unit 111 of the CPU 101 determines whether to measure a circumference. The condition to determine whether to measure a circumference includes the following examples. This determination corresponds to determination of whether to perform image density calibration control.

- a case wherein the number of conveyed sheets after previous circumference measurement is equal to or larger than a predetermined number of sheets.
- a case wherein an environment parameter has varied by a predetermined value or more from the environment in previous circumference measurement.
- a case wherein the standing time after the final print job is equal to or longer than a predetermined time.
- a case wherein a process cartridge has been exchanged.

In step S902, the circumference measurement unit 111 instructs the driving control unit 108 to drive the intermediate transfer belt 31. Then, driving of the intermediate transfer belt 31 starts.

In step S903, the circumference measurement unit 111 causes the light emitting element 301 of the optical sensor 104 to emit the same quantity of light as that in image density calibration control. The background reflects light emitted from the light emitting element 301, and the light receiving element 302 receives the reflected light. The light receiving element 302 outputs a signal corresponding to the reflected light quantity.

In step S904, the circumference measurement unit 111 executes sampling of the first round for the output value of reflected light received by the light receiving element 302. A reflected light output value at each sampling point is stored in the RAM 103 as the waveform profile (first waveform data) of the first round. That is, the circumference measurement unit 111 is an example of an acquisition unit which acquires a pattern as a waveform profile. The circumference measurement unit 111 acquires waveform profiles a plurality of number of times, which will be described later. Acquisitions at respective timings can also be referred to as the first acquisition, second acquisition, and the like. The waveform profile of the first round is an arbitrary profile of reflected light in an arbitrary section on the rotation member because sampling starts at an arbitrary position. The following description will use the term "waveform profile". The waveform profile means the characteristic or feature of measured waveform data.

By this sampling, 1,000 data are acquired in 0.1-mm cycles. The 1,000 data correspond to 100 mm. Considering that the nominal circumference is 800 nm, the length of 100 mm is about ⅛ of the entire length. The measurement start timing in the first round is arbitrary. That is, no intermediate transfer belt need rotate until a specific mark reaches the detection point. This leads to a short downtime. This sampling need not acquire data of one round of the intermediate transfer belt 31. It suffices to acquire data of about ⅛ of the entire length, reducing the memory consumption for storing acquired data.

Figure 10:
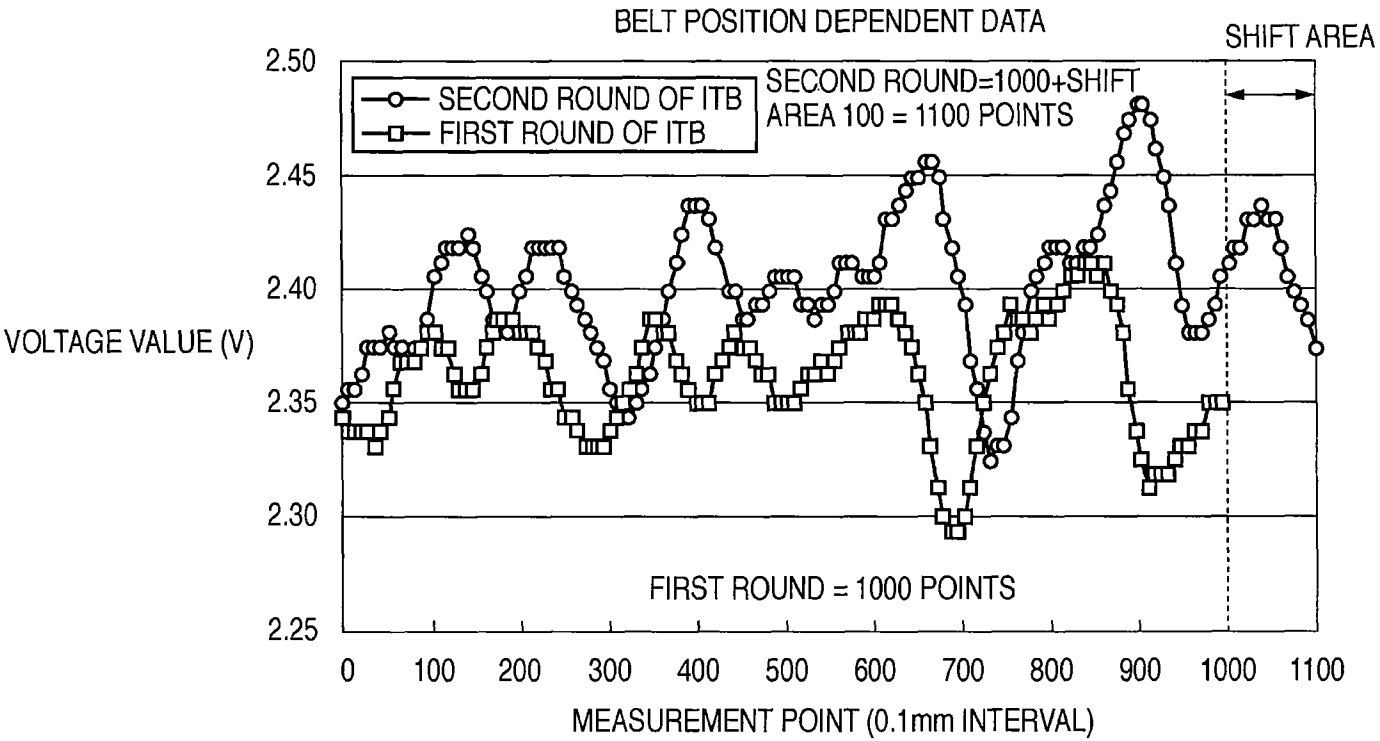
FIG. 10 is a graph showing an example of the relationship between each sampling point and a reflected light output value.

FIG. 10 is a graph showing an example of the relationship between each sampling point and a reflected light output value for two waveform data acquired from the RAM 103. FIG. 10 shows the waveform profiles of the first and second rounds. The waveform profile of the second round contains a larger number of sample values than those in the waveform profile of the first round because a shift area exists. The shift area is a margin for obtaining a shift amount from the nominal circumference. The shift area is determined in consideration of the maximum circumference change amount which is the maximum value of the circumference change amount (expansion and contraction characteristic) of the intermediate transfer belt 31.

Based on the waveform data detection timing of the first round (for example, at the same time as the start of sampling), the circumference measurement unit 111 activates a timer for determining the sampling start timing of the second round. Waveform data of the second round is sampled so that the section of the image-formed surface of one of the waveform data of the first and second rounds falls within the section of the image-formed surface corresponding to the other waveform data. In other words, when the circumference measurement unit 111 acquires two waveform data from the RAM 103, the section of an image-formed surface corresponding to one waveform data falls within that of an image-formed surface corresponding to the other waveform data. From this, waveform data of the second round is sampled at a timing which is adjusted by a predetermined time from a predetermined reference time necessary for the intermediate transfer belt 31 to rotate only one round by using the waveform data detection timing of the first round as a reference. The RAM 103 stores the sampled waveform data. In the case of FIG. 9, a value obtained by subtracting half the maximum circumference change amount from one nominal circumference is set in the timer. The value subtracted from one nominal circumference when setting the timer is not limited to half the maximum circumference change amount. A predetermined value may also be set as long as no measurement error frequently occurs. When the timing set in the timer has come, the process advances to step S905.

As shown in FIG. 10, waveform data acquired from the RAM 103 corresponds to the section of part of the intermediate transfer belt 31 serving as a rotation member. The amount of data stored in the RAM 103 in sampling can be reduced, suppressing memory utilization.

In step S905, the circumference measurement unit 111 executes sampling of the second round for the output value of reflected light received by the light receiving element 302. The number of sampling points in the second round is larger than that of sampling points in the first round, and corresponds to a long detection time. Considering a shift amount from the nominal circumference, one waveform data corresponds to a longer sampling time (detection time) than the other waveform data.

Figure 11:
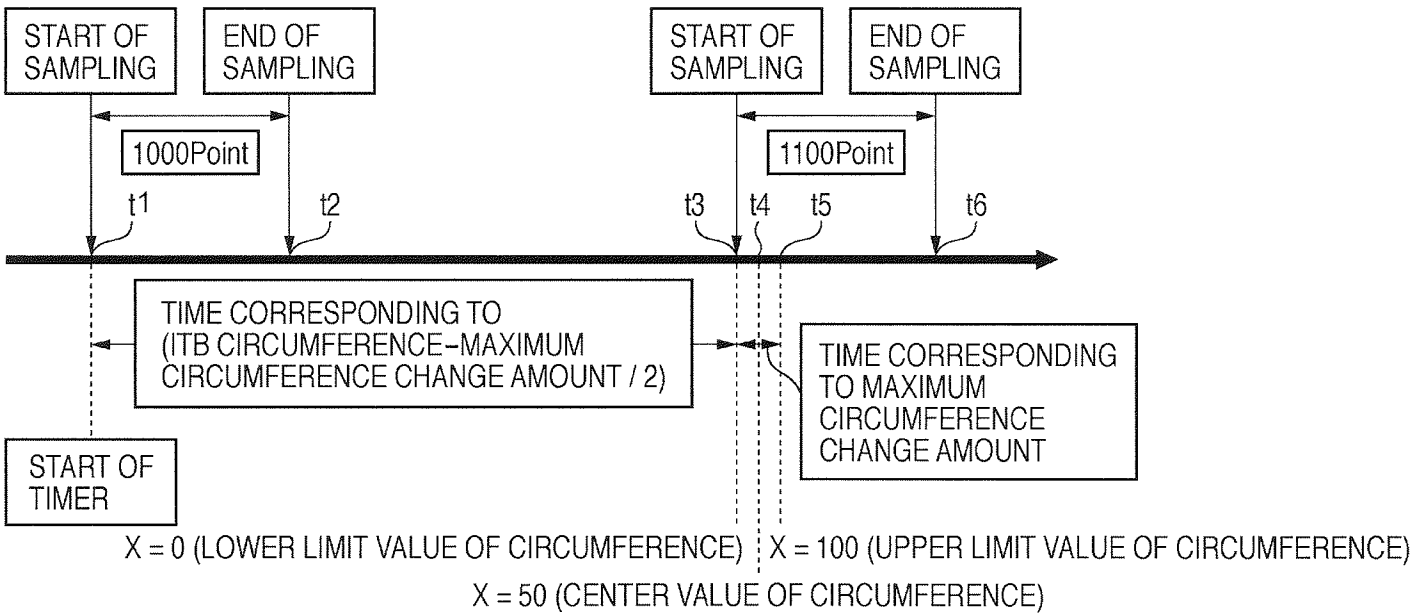
FIG. 11 is a timing chart for explaining timings from the sampling start timing t1 of the first round to the sampling end timing t6 of the second round.

FIG. 11 is a timing chart for explaining timings from the sampling start timing t1 of the first round to the sampling end timing t6 of the second round. t1 represents the sampling start timing (first timing) of the first round. t2 represents the sampling end timing of the first round, and t3 represents the sampling start timing (second timing) of the second round. t4 represents a timing corresponding to the nominal circumference from t1 serving as the start point. t5 represents a timing when the expansion amount of the circumference maximizes.

The interval between t1 and t2 represents the sampling period (first period) of the first round. The interval between t3 and t6 represents the sampling period (second period) of the second round.

The interval between t1 and t3 corresponds to the shortest time necessary for the intermediate transfer belt to rotate when the circumference of the intermediate transfer belt 31 varies to be the shortest. That is, the interval between t1 and t3 is the time calculated by dividing, by the process speed, a length obtained by subtracting half the maximum circumference change amount from the nominal circumference of the intermediate transfer belt. This aims at making the sampling start point of the first round fall within the section where the waveform profile of the second round has been acquired. If sampling is executed slightly excessively, the interval between t1 and t3 may also be further shortened.

The interval between t1 and t4 is the time obtained by dividing the nominal circumference of the intermediate transfer belt 31 by the process speed. The interval between t1 and t4 is a reference time necessary for the intermediate transfer belt 31 having the nominal circumference to rotate one round.

The sampling interval of the second round is 0.1 mm, similar to the first round. However, the number of sampling points in the second round is larger than that of sampling points in the first round. When the number of sampling points in the first round is 1,000 and the shift amount is 100 points, the number of sampling points in the second round is 1,100. In this example, the maximum circumference change amount is 10 mm. The RAM 103 also stores the waveform profile (second waveform data) of the second round. FIG. 10 shows the relationship between each sampling point and a reflected light output value.

In the flowchart of FIG. 9, all sampled data are handled as waveform data, but the data are not limited to them. It suffices to acquire data for pattern matching calculation (to be described later). For example, extra sampling may also be done at the start and/or end timing to acquire two waveform data necessary for pattern matching calculation from the memory. As a example, a case wherein only data necessary for pattern matching calculation are sampled will be exemplified.

After the end of sampling in the first and second rounds, a variable X representing the shift amount is initialized to 0 in step S906. As will be described later, the circumference measurement unit 111 compares the waveform profile of the first round, and a plurality of waveform profiles (third waveform data) which are shifted by different shift amounts in the waveform profile of the second round and are equal in length to the waveform profile of the first round. The third waveform data are reflected light comparison profiles in a plurality of sections that are shifted by different shift amounts from a reference position based on one nominal circumference starting from the start position of a section where the waveform profile of the first round has been acquired.

In step S907, the circumference measurement unit 111 accumulates difference absolute values between the waveform profile of the first round and that (third waveform data) of the second round, in order to perform pattern matching between the two waveform data. For example, the accumulation is executed by $$I(X) = \sum_{i=1}^{1000} |V_{first\ round}(i) - V_{second\ round}(i + X)| \quad (2)$$

where I(X) is an accumulated value for the shift amount X, $V_{first\ round}(i)$ is a reflected light output value at the point i in the first round, and $V_{second\ round}(i+X)$ is a reflected light output value at the point i+X in the second round. Note that X=0, 1, 2, . . . , 100.

In step S908, the circumference measurement unit 111 stores the accumulated value I(X) in the RAM 103. In step S909, the circumference measurement unit 111 increments the X value by one. In step S910, the circumference measurement unit 111 determines whether the X value has exceeded the maximum shift amount. If no X value has exceeded the maximum shift amount, the process returns to step S907. If the X value has exceeded the maximum shift amount, the process advances to step S911. In this fashion, the circumference measurement unit 111 calculates accumulated values I(X) for all X from X=0 to X=100.

In step S911, the circumference measurement unit 111 determines the minimum value among the calculated accumulated values I(X). When $V_{first\ round}(i)$ as one of two waveform data is used as reference waveform data, waveform data which matches $V_{first\ round}(i)$ can be extracted by the processing of determining the minimum accumulated value. Similarly in step S911, X corresponding to the minimum accumulated value I is extracted. The specified X represents a shift (expansion or contraction) from a predetermined nominal circumference serving as a reference. Thus, X is information (interval information) corresponding to the interval between $V_{first\ round}(i)$ serving as reference waveform data, and waveform data corresponding to X which gives a minimum accumulated value I. The X value becomes larger as the interval between reference waveform data and waveform data corresponding to X which gives a minimum accumulated value I becomes larger, and vice versa.

Figure 12:
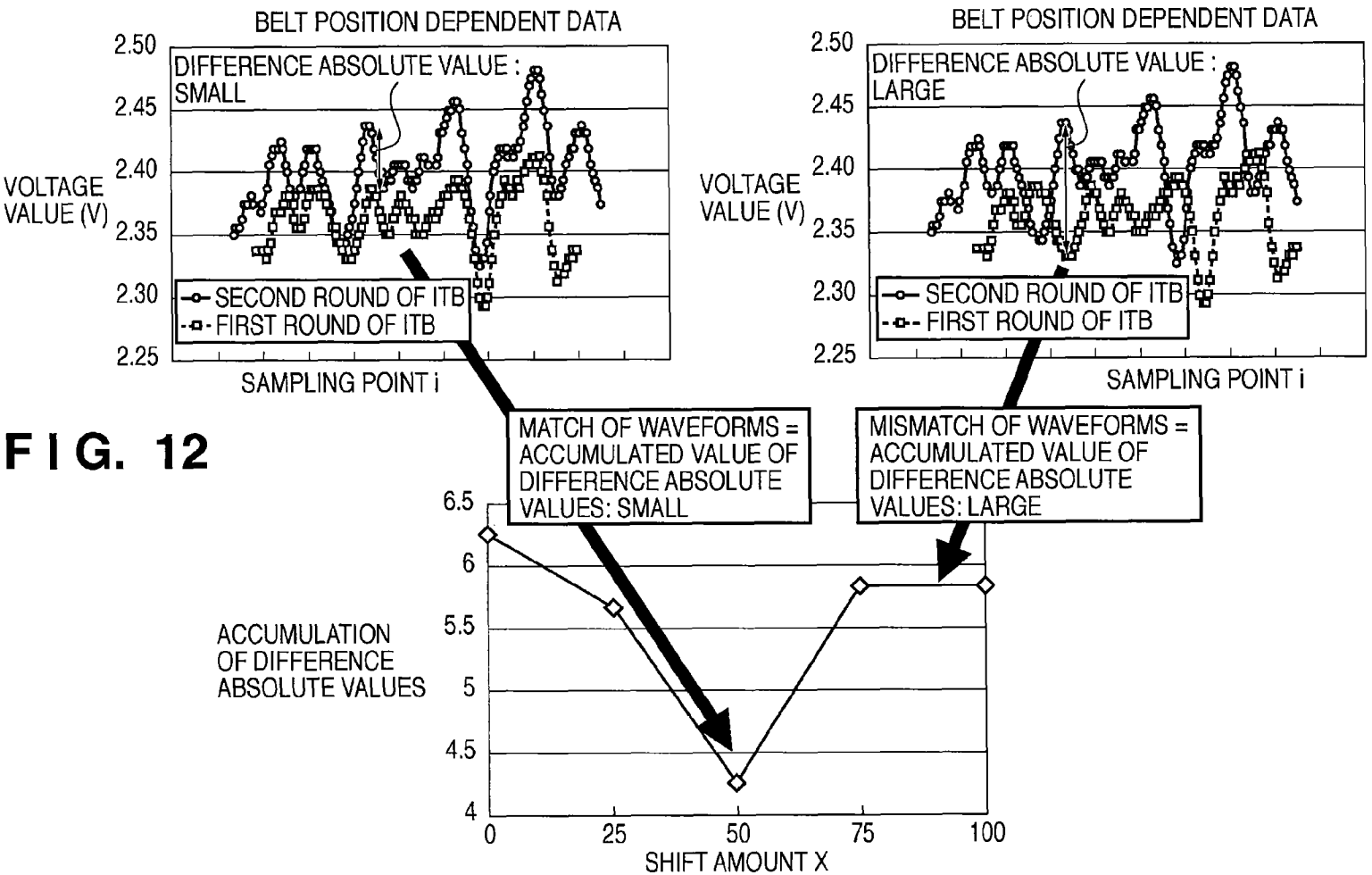
FIG. 12 is a graph showing the relationship between the waveform profiles of the first and second rounds and accumulated values according to the first embodiment.

FIG. 12 is a graph showing the relationship between the waveform profiles of the first and second rounds and accumulated values according to the first embodiment. FIG. 12 shows that the accumulated value minimizes when the correlation between two waveform profiles maximizes. This is based on the fact that reflected light output values detected at the same position are almost equal to each other. In contrast, reflected light output values detected at different positions have a low correlation and different waveform profiles. Thus, the accumulated value becomes relatively large. From this, the circumference measurement unit 111 has a function of extracting a comparison profile closest to an arbitrary profile from a plurality of comparison profiles. In this manner, a portion where the correlation between the waveforms of the first and second rounds is high is specified by equation (2), calculating information associated with the circumference of the intermediate transfer belt 31. This is a feature of the present invention.

In step S912, the circumference measurement unit 111 calculates an actual circumference which is information for grasping the circumference of the intermediate transfer belt and information (interval information) corresponding to the interval between waveform data. The circumference measurement unit 111 stores the calculated actual circumference in the RAM 103 or nonvolatile memory 109. The RAM 103 or nonvolatile memory 109 is an example of a storage unit which stores information representing a measured actual circumference. For example, the actual circumference can be calculated by equation (3) using an X value which gives a minimum accumulated value. Equation (3) calculates the actual circumference of the rotation member from the nominal circumference and a shift amount obtained by comparing extracted waveform data and reference waveform data:

$$\text{actual circumference} = (X_{profile\ result} - X_{ITB\ ideal}) * 0.1 + \text{nominal circumference} \quad (3)$$

where $X_{profile\ result}$ is X which gives a minimum the accumulated value obtained in step S911, $X_{ITB\ ideal}$ is X (in this case, X=50) when the ITB circumference has a nominal value, and the nominal circumference is an ideal dimension value (792.1 mm for the intermediate transfer belt 31 of the first embodiment) when the ITB circumference is free from any manufacturing tolerance or environmental variations. The term "$(X_{profile\ result} - X_{ITB\ ideal})*0.1$" in equation (3) represents a shift (unit: mm) from an ideal dimension value when the measured circumference of the intermediate transfer belt 31 is free from any manufacturing tolerance or environmental variations. "*0.1", corresponds to sampling at an interval of 0.1 mm. When sampling is executed at an interval of 0.2 mm, it suffices to multiply 0.2.

When storing obtained information for grasping an actual circumference, the information may also be converted into time or length. In short, as described with reference to FIG. 7, information can be used to monitor the lapse of time during which the intermediate transfer belt 31 rotates one round accurately. The circumference measurement unit 111 also functions as a unit which calculates the actual circumference of a rotation member from a shift amount corresponding to an extracted comparison profile and the nominal circumference.

The density calibration control unit 112 of the CPU 101 executes the above-described image density calibration control using the value calculated by equation (3) serving as information associated with the actual circumference of the intermediate transfer belt 31 that has been finalized in step S912. As the information associated with the actual circumference, an expansion and contraction amount may also be obtained from a value calculated by subtracting 50 from X which gives a minimum accumulated value, and the time during which an arbitrary position rotates one round may also be calculated based on the obtained expansion and contraction amount. More specifically, the time (negative value for a negative expansion and contraction amount) corresponding to the obtained expansion and contraction amount is added to the time taken for the intermediate transfer belt 31 having the nominal circumference to rotate one round. As a result, image density calibration control can be executed accurately.

After executing image density calibration control, the CPU 101 returns to step S101 again. If the circumference measurement condition is satisfied, the CPU 101 executes the flowchart shown in FIG. 9.

Figure 13:
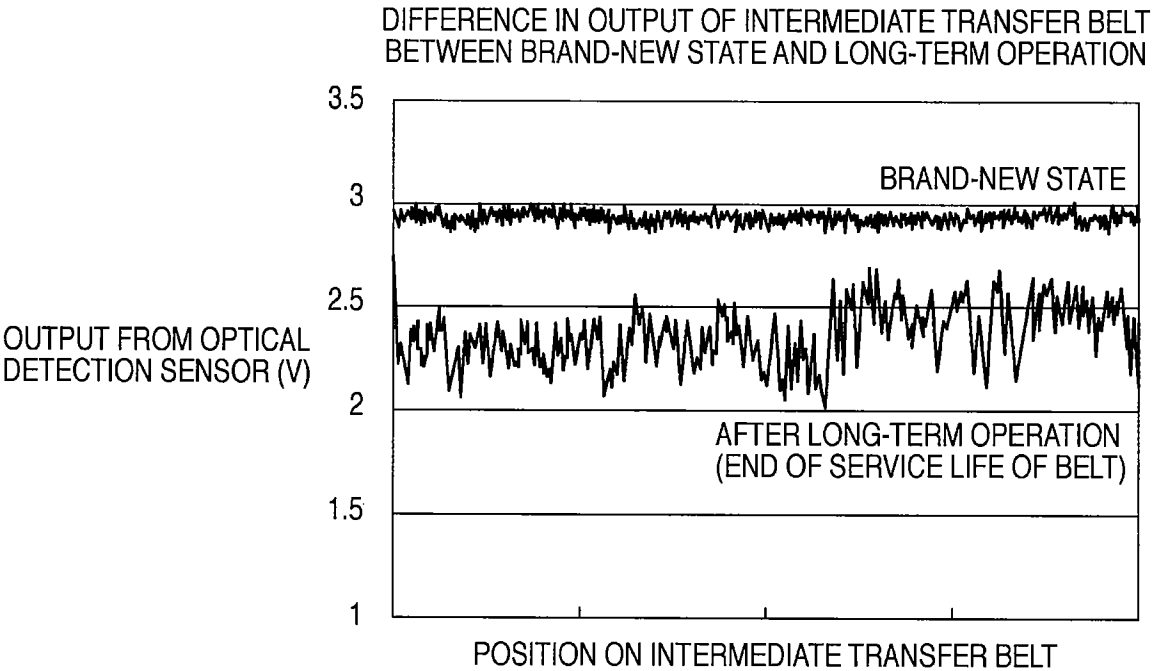
FIG. 13 is a graph showing the position dependence of an intermediate transfer belt 31 when a light receiving element 302 receives light reflected by the background of the intermediate transfer belt 31.

FIG. 13 is a graph showing the position dependence of the intermediate transfer belt 31 when the light receiving element 302 receives light reflected by the background of the intermediate transfer belt 31. As shown in FIG. 13, when the intermediate transfer belt 31 is a new one, background reflected light is almost uniform regardless of the position on the intermediate transfer belt 31. When the intermediate transfer belt 31 comes close to the end of its service life after conveying many papers (many printed papers), background reflected light becomes nonuniform depending on the position on the intermediate transfer belt 31.

According to the circumference measurement method of the first embodiment, the circumference of the intermediate transfer belt 31 is obtained by detecting a portion where the waveform profiles of the first and second rounds coincide with each other. As nonuniformity of background reflected light depending on the position on the intermediate transfer belt 31 is larger, the reliability of the detection result becomes higher. Even if the intermediate transfer belt 31 changes over time, the circumference can be obtained.

Figure 14:
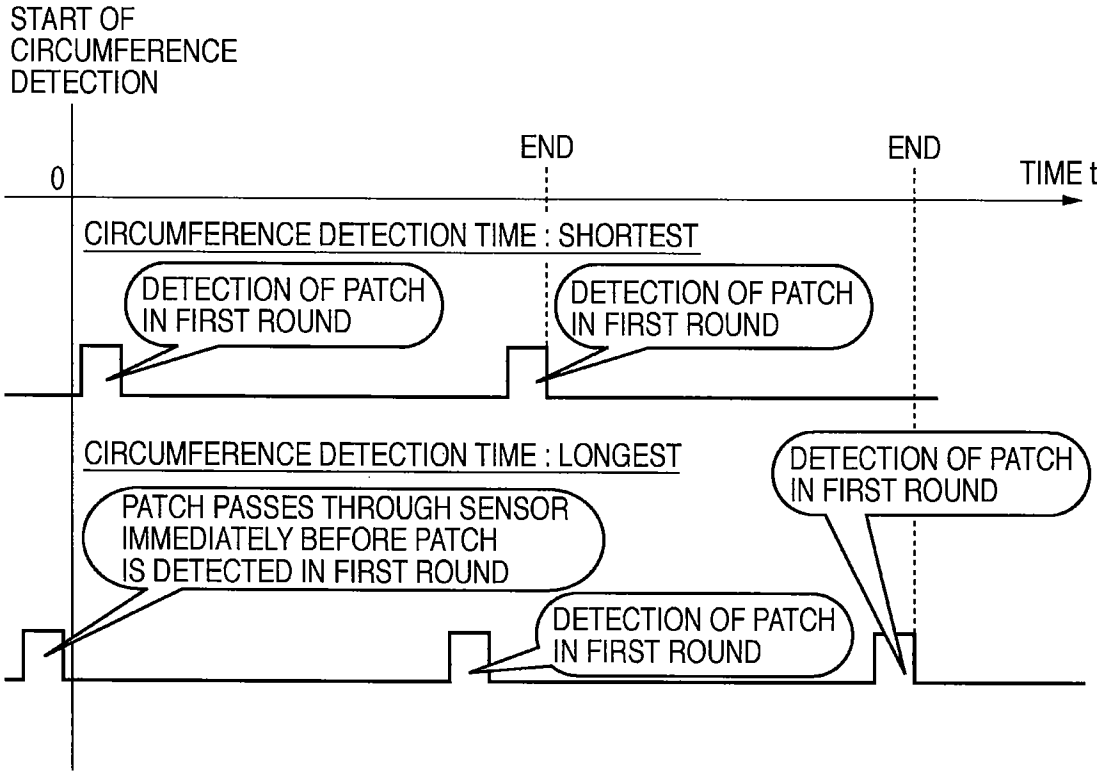
FIG. 14 is a timing chart showing the timing when a patch is detected by a circumference measurement method serving as a comparative example.

The result of detecting the circumference of the intermediate transfer belt 31 by using the circumference measurement method according to the first embodiment will be explained with reference to FIG. 14 and Table 1 in comparison with a result by a circumference measurement method serving as a comparative example. FIG. 14 is a timing chart showing the timing when a patch is detected by the circumference measurement method serving as a comparative example. Table 1 represents the circumference detection precision and the maximum time taken for the circumference detection when the circumference of the intermediate transfer belt 31 was detected 50 times by the circumference measurement method according to the first embodiment, and the detection precision and the maximum time taken for the circumference detection by the circumference measurement method serving as a comparative example. According to the circumference measurement method serving as a comparative example, a mark is attached to the surface of the intermediate transfer belt, and the optical sensor receives light reflected by the mark, thereby measuring the circumference of the intermediate transfer belt.

As shown in FIG. 14, according to the circumference measurement method serving as a comparative example, the maximum time taken for circumference detection is the time taken for the intermediate transfer belt 31 to rotate two rounds at maximum. The maximum time is as long as 8.8 sec, as represented in Table 1. In contrast, the circumference measurement method of the first embodiment can start circumference measurement at an arbitrary timing, and can shorten the time by about 4 sec from that of the comparative example. That is, the circumference measurement method of the first embodiment can shorten the processing time taken to measure the circumference of the intermediate transfer belt 31. The circumference detection precision by the circumference measurement method of the first embodiment is as high as 0.4 mm, similar to the comparative example.

TABLE 1

| | Detection Precision (Max − Min) | Maximum Time Taken For Circumference Detection (sec) |
|---|---|---|
| Comparative Example (Circumference Detection Mark + Circumference Detection Sensor) | 0.4 mm | 8.8 sec |
| Circumference Measurement Method of Present Invention (Detection Sensor Also Serves As Density Detection Sensor) | 0.4 mm | 4.9 sec |

Figure 15:
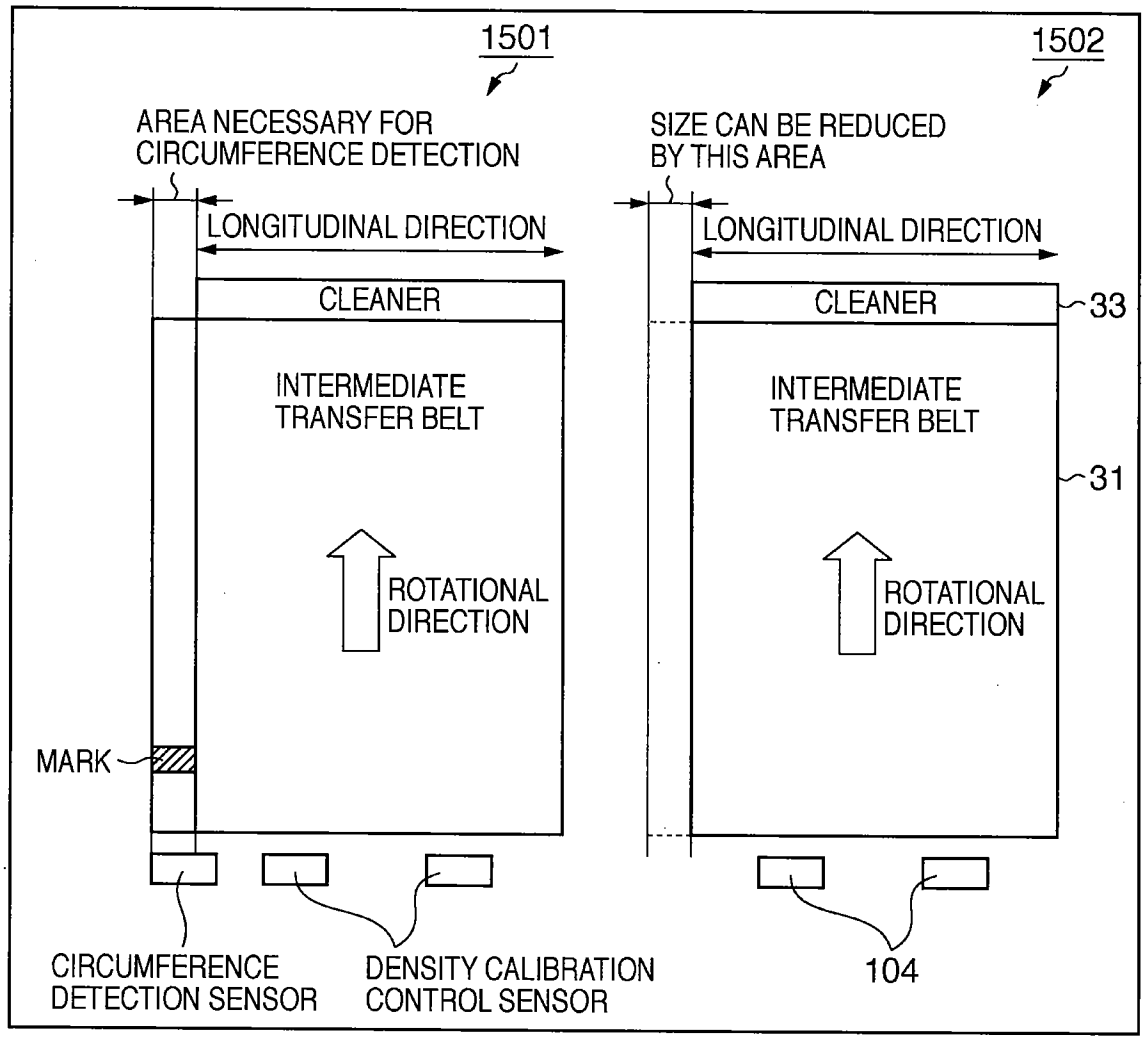
FIG. 15 is a view showing the operation of a cleaner.

The reason why the circumference measurement method according to the first embodiment is effective for downsizing the apparatus will be explained with reference to FIG. 15. FIG. 15 is a view showing the operation of the cleaner. An arrangement 1501 is necessary for circumference measurement by the comparative example. An arrangement 1502 is necessary for circumference measurement by the first embodiment.

In the comparative example, when the mark exists within a longitudinal range in the cleaning area of the cleaner in the arrangement 1501, the cleaner passes over the mark, degrading the cleaning performance of the cleaner. To prevent this, the mark must be arranged at a position where it does not overlap the longitudinal range in the cleaning area of the cleaner 33, as represented by the arrangement 1501. The circumference detection mark needs to be arranged at an end in the longitudinal direction. As a result, the comparative example cannot downsize the image forming apparatus. The circumference detection mark is generally set to a size of 8 to 10 mm in order to detect it by a circumference detection sensor even when the belt skews by a maximum amount. To the contrary, the circumference measurement method according to the first embodiment requires neither the circumference detection sensor nor mark, as represented by the arrangement 1502, and is advantageous for downsizing the apparatus.

As described above, the image forming apparatus according to the first embodiment detects waveform data of the image-formed surface of a rotation member at an arbitrary timing. The image forming apparatus detects the waveform data of the second round at a timing upon the lapse of a predetermined time from the arbitrary timing in the second round. The image forming apparatus obtains information associated with the actual circumference of the rotation member using the respective detected waveform data. The image forming apparatus need adopt neither a mark nor an optical sensor for detecting the mark, unlike the circumference measurement method described as the comparative example in which a mark is formed at the end of the rotation member to measure the actual circumference of the rotation member using an optical sensor for detecting the mark. To maintain the detection precision, the mark is formed at the end of the rotation member that is not an image-formed surface. The mark formed at the end makes the rotation member wider. Further, the optical sensor for detecting the mark needs to be arranged at a position where it can detect the mark. This increases the apparatus size and cost. Unlike the comparative example, the image forming apparatus according to the first embodiment obtains information associated with the actual circumference of the rotation member by detecting waveform data of the image-formed surface of the rotation member. Thus, the image forming apparatus is advantageous for reducing the apparatus size and cost.

In the comparative example, the rotation member needs to be driven to rotate two rounds at maximum depending on the first mark position because the mark is detected twice in order to measure the circumference. However, the image forming apparatus according to the first embodiment starts detecting waveform data of the first round at an arbitrary timing. In the image forming apparatus, the time taken to detect waveform data is a period obtained by adding the time taken for the rotation member to rotate one round and the time taken to detect waveform data of the second round. The image forming apparatus can shorten the time taken for circumference measurement, compared with the comparative example.

The image forming apparatus need not form a patch image or the like for measuring the circumference of the rotation member, and is advantageous in processing load and toner consumption. Further, in the image forming apparatus, the optical sensor emits light to the image-formed surface of the rotation member in order to acquire a waveform profile. As the optical sensor, a density calibration control optical sensor or color misalignment calibration control optical sensor is available, reducing the cost. The image forming apparatus can detect a relative position on the rotation member and the expansion and contraction characteristic of the rotation member by using waveform data of the image-formed surface of the rotation member. The image forming apparatus can execute higher-precision circumference measurement even for a rotation member after long-term operation.

The image forming apparatus performs pattern matching between two acquired waveform data. Even if the intermediate transfer belt 31 deteriorates, two waveform data corresponding to the deteriorated belt surface are compared, accurately obtaining information associated with the circumference. That is, the image forming apparatus is resistant to deterioration over time. The image forming apparatus can obtain information associated with the actual circumference of the rotation member by acquiring the waveform profile of only a partial section. The efficiency of utilization of a memory which holds the acquired waveform profile can increase.

The image forming apparatus according to the first embodiment can shorten the time taken for circumference detection of the rotation member, measure the circumference at high precision, and execute more accurate density calibration control. In addition, the image forming apparatus according to the first embodiment can prevent an increase in cost when assembling the mechanism for obtaining information associated with the actual circumference of the rotation member.

<Second Embodiment>

The second embodiment will be explained with reference to FIGS. 16 to 18. The second embodiment adopts an image forming apparatus (ETB type) which employs a tandem type direct transfer method. According to the tandem type direct transfer method, a plurality of image forming stations are series-arranged to form toner images of different colors. The toner images are sequentially transferred onto a printing material such as printing paper. The control arrangement of the image forming apparatus, the arrangement of the optical detection sensor, and the algorithms of image density calibration control and circumference measurement are the same as those in the first embodiment, and a description thereof will not be repeated.

[Image Forming Apparatus System]

Figure 16:
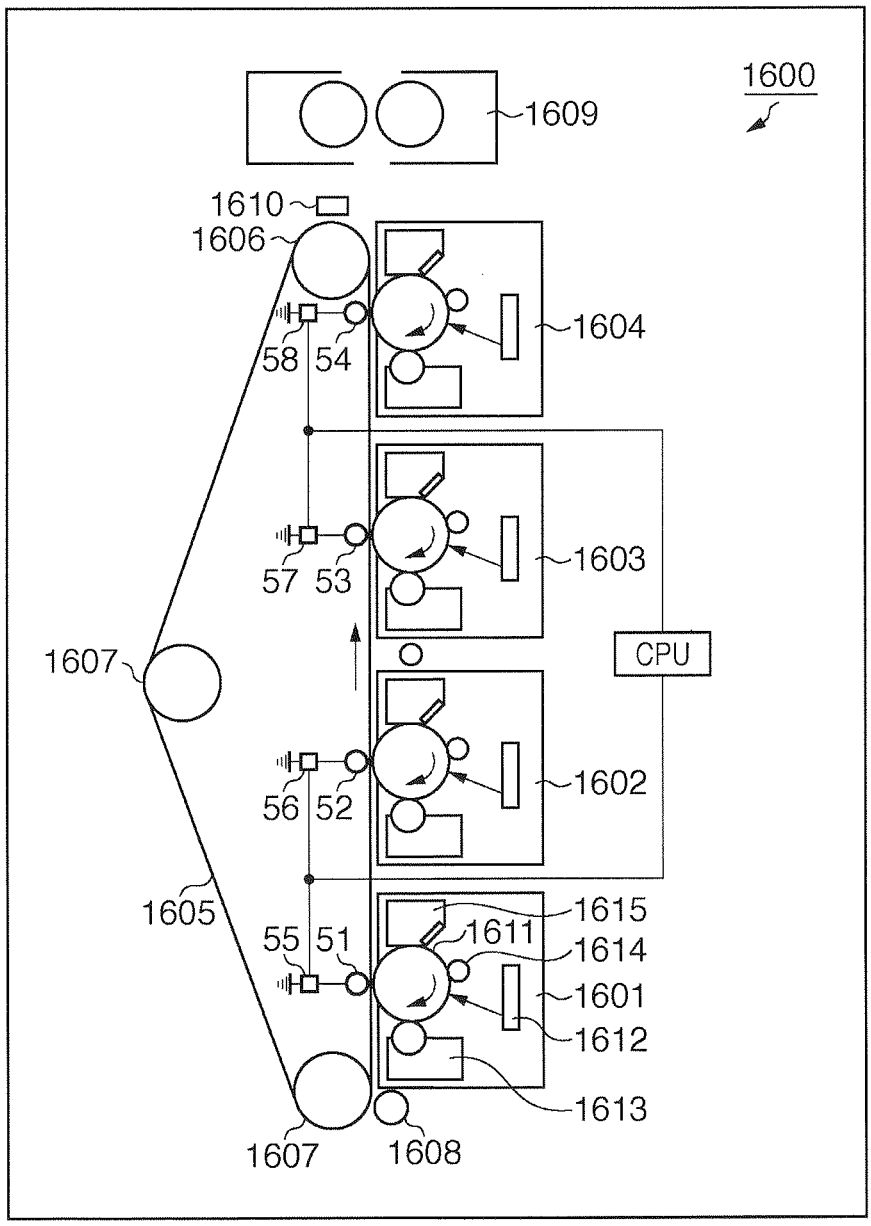
FIG. 16 is a schematic sectional view of a color image forming apparatus according to the second embodiment.

FIG. 16 is a schematic sectional view of a color image forming apparatus according to the second embodiment. An image forming apparatus 1600 according to the second embodiment includes four image forming stations 1601, 1602, 1603, and 1604. For example, the image forming station 1601 forms a yellow (Y) image, the image forming station 1602 forms a magenta (M) image, the image forming station 1603 forms a cyan (C) image, and the image forming station 1604 forms a black (Bk) image.

The image forming station 1601 will be explained. The remaining image forming stations 1602 to 1604 also have the same arrangement, and a description thereof will not be repeated. The image forming station 1601 includes a photosensitive drum 1611, exposure unit 1612, developing unit 1613, primary charging roller 1614, and cleaner 1615. The photosensitive drum 1611 is configured by forming an organic photoconductive layer (OPC photoconductive layer) as a surface layer on an electrically grounded base such as an aluminum cylinder. The photosensitive drum 1611 is driven to rotate at a predetermined circumferential speed (process speed) counterclockwise, as indicated by an arrow in FIG. 16. The process speed of the image forming apparatus according to the second embodiment is 180 mm/sec.

During rotation, the primary charging roller 1614 uniformly charges the surface of the photosensitive drum 1611 to a potential of a predetermined polarity (negative polarity in the second embodiment). The exposure unit 1612 exposes the photosensitive drum 1611 to an image based on image information, forming an electrostatic latent image on the photosensitive drum 1611.

The developing unit 1613 develops the electrostatic latent image formed on the photosensitive drum 1611 with a toner (negatively charged toner) of a color corresponding to each image forming station. The electrostatic latent image is visualized as, for example, a yellow toner image. The developing unit 1613 adopts a monocomponent contact development method. The developing unit 1613 includes a developing roller in contact with the photosensitive drum 1611. The developing roller supports a thin toner layer and carries it to the developing portion. The latent image is developed by a developing bias (negative voltage in the second embodiment) applied to the developing roller. Toner is a so-called nonmagnetic toner containing no magnetic substance.

The image forming stations 1601 to 1604 are arranged along the moving direction of an electrostatic attraction conveyance belt (transfer belt) 1605 serving as a printing material carrier for conveying a printing material in the longitudinal direction (upward in the vertical direction). The transfer belt 1605 is looped between a driving roller 1606 and two tension rollers 1607, and driven to rotate counterclockwise indicated by an arrow at almost the same circumferential speed as that of the photosensitive drum 1611.

Transfer rollers 51 to 54 respectively connected to high-voltage power supplies (constant-voltage power supplies) 55 to 58 are arranged for the image forming stations 1601 and 1604. The transfer rollers 51 to 54 are in contact with the nips (transfer portions) of the photosensitive drums from the back surface of the transfer belt 1605.

The transfer belt 1605 receives a printing material such as paper fed from a paper cassette (not shown) via a pair of registration rollers (not shown). An attraction current is supplied from the high-voltage power supply (constant-current power supply) to the interval between an attraction roller 1608 in contact with the transfer belt 1605 and the tension roller 1607 facing the attraction roller 1608. Then, the printing material is electrostatically attracted to the surface of the transfer belt 1605 at the nip (attraction portion) of the transfer belt 1605. The printing material is conveyed in the longitudinal direction along with rotation of the transfer belt 1605. The attraction roller 1608 is formed by applying solid rubber on a core. A high-voltage bias for attraction is applied to the core.

By a transfer voltage (positive voltage in the second embodiment) applied from the high-voltage power supply 55 to the transfer roller 51, a yellow toner image of the first color formed on the photosensitive drum 1611 is transferred onto the printing material conveyed to the transfer nip of the image forming station 1601. In the respective image forming stations, a magenta toner image of the second color, a cyan toner image of the third color, and a black toner image of the fourth color are sequentially transferred onto the printing material. As a result, a full-color image of the toner images of the four colors is formed on the printing material.

The printing material bearing the toner images of all the colors is separated from the upper end of the transfer belt 1605 by the curvature of the belt, and conveyed to a fixing unit (pair of fixing rollers) 1609. The fixing unit 1609 heats and fixes the toner image onto the printing material. After that, the printing material is discharged from the apparatus. After the end of transfer, the photosensitive drum 1611 is cleaned by scraping toner left on the surface after transfer by the cleaning blade of the cleaner 1615. The photosensitive drum 1611 waits for the next image formation.

In the second embodiment, the transfer belt 1605 is an endless PVDF single-layer resin belt 100 μm thick whose resistivity is adjusted to 10E9 Ω·cm by adding an ion conductor. The volume resistivity of the transfer belt 1605 may be set to 10E7 to 10E11 Ωcm in order to prevent the rise of the transfer voltage upon increasing charges, and sufficiently attenuate the charging potential of the transfer belt 1605 in preparation for the next image formation. To attract a printing material, a transfer belt higher in volume resistivity than a printing material in a normal environment is desirably selected. As described above, the second embodiment employs a transfer belt having a volume resistivity of 10E9 Ωcm.

The transfer belt 1605 is cleaned by applying a bias of an opposite polarity in cleaning to recover toner left on the transfer belt 1605 into each photosensitive drum. The transfer belt 1605 does not require a cleaning member such as a cleaning blade.

In the image forming apparatus 1600 according to the second embodiment, the circumference of the transfer belt 1605 may also be measured by arranging a circumference detection mark and circumference detection sensor at the end of the belt in the longitudinal direction. Alternatively, the circumference of the transfer belt 1605 may also be measured by forming patches immediately below an optical sensor 1610, and specifying the circumference of the transfer belt 1605 from the interval between the patches.

The optical sensor 1610 for performing image density calibration control is arranged at a position where it faces the driving roller 1606. In the second embodiment, the circumference of the transfer belt 1605 is measured using the optical sensor 1610 which is also used for image density calibration control. The nominal circumference value of the transfer belt 1605 in the image forming apparatus 1600 is 792.1 mm, similar to the first embodiment. Similar to the first embodiment, the circumference of the transfer belt 1605 varies from the nominal circumference value owing to the manufacturing tolerance, use environment, and durability.

Figure 17:
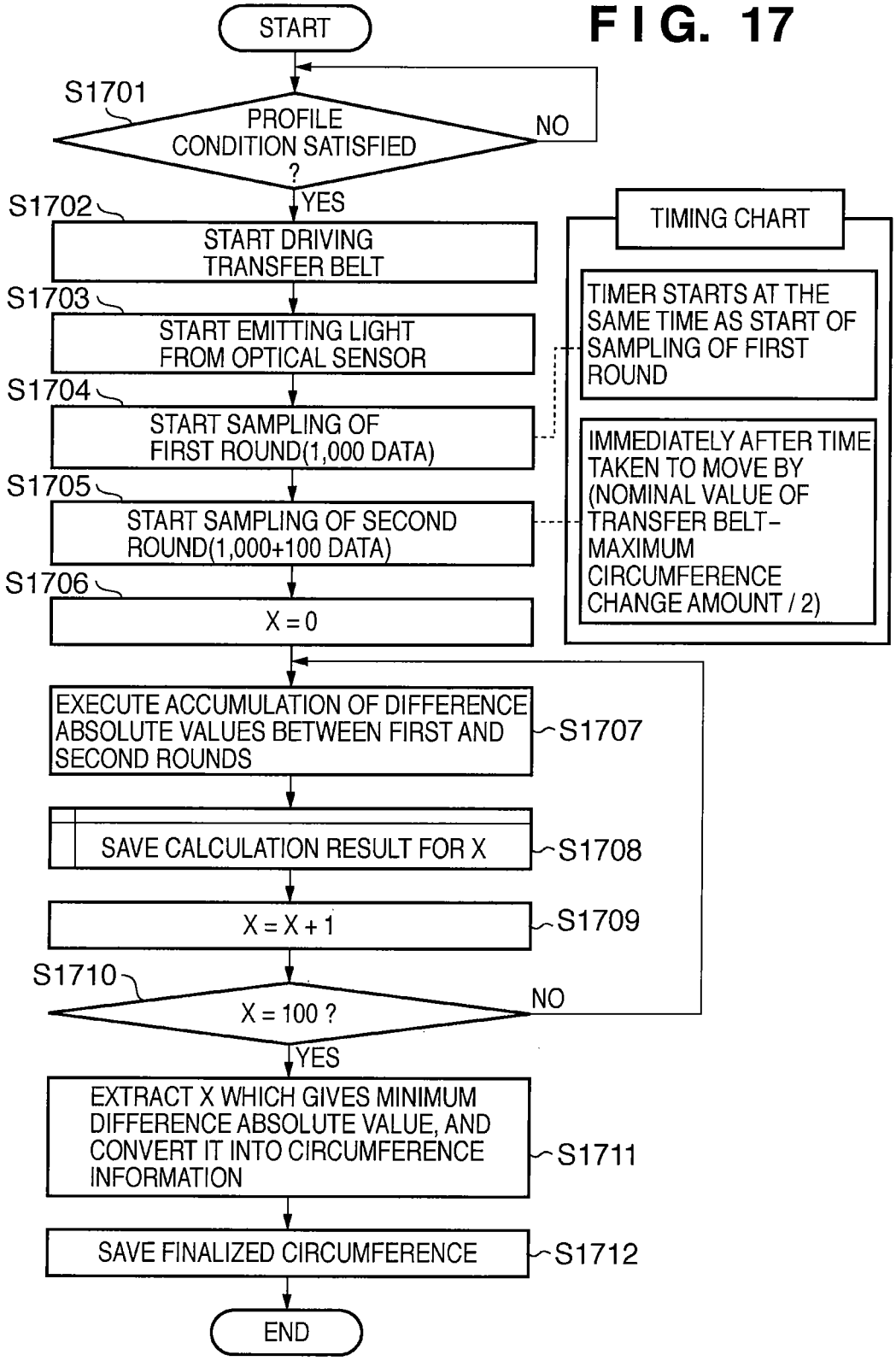
FIG. 17 is a flowchart showing processing to obtain information associated with the actual circumference of a transfer belt according to the second embodiment.

FIG. 17 is a flowchart showing processing to cause a CPU 101 to acquire two waveform data and obtain information associated with the actual circumference of the transfer belt based on matching between the two waveform data in the second embodiment. Similar to the first embodiment, the CPU 101 executes the flowchart shown in FIG. 17 by loading a control program stored in a ROM 102 into a RAM 103. The first embodiment has exemplified the intermediate transfer belt 31 as a rotation member to undergo circumference detection. The second embodiment will exemplify the electrostatic attraction conveyance belt (transfer belt) 1605 as a rotation member to undergo circumference detection. Those skilled in the art will understand the flowchart in FIG. 17 even if the electrostatic attraction conveyance belt (transfer belt) 1605 replaces the circumference detection target in the flowchart of FIG. 9. For this reason, a description of the same processes as those in the flowchart shown in FIG. 9 will not be repeated. More specifically, processes in S1701 and S1703 to S1712 are the same as those in S901 and S903 to S912, and a description thereof will not be repeated.

In step S1702, a circumference measurement unit 111 instructs a driving control unit 108 to drive the target transfer belt 1605 serving as an electrostatic attraction conveyance belt. Then, driving of the transfer belt 1605 starts.

The result of detecting the circumference of the transfer belt 1605 by using the circumference measurement method according to the second embodiment will be explained with reference to FIG. 18 and Table 2 in comparison with a result by a circumference measurement method serving as a comparative example. FIG. 18 is a view for explaining a circumference measurement method serving as a comparative example. Table 2 represents the circumference detection precision and the maximum time taken for the circumference detection when the circumference of the transfer belt 1605 was detected 50 times by the circumference measurement method according to the second embodiment, and the detection precision and the maximum time taken for the circumference detection by the circumference measurement method serving as a comparative example. Comparative example 1 in Table 2 is a circumference measurement method using an arrangement 1501 shown in FIG. 15. Comparative example 2 is a circumference measurement method to be described with reference to FIG. 18.

Figure 18:
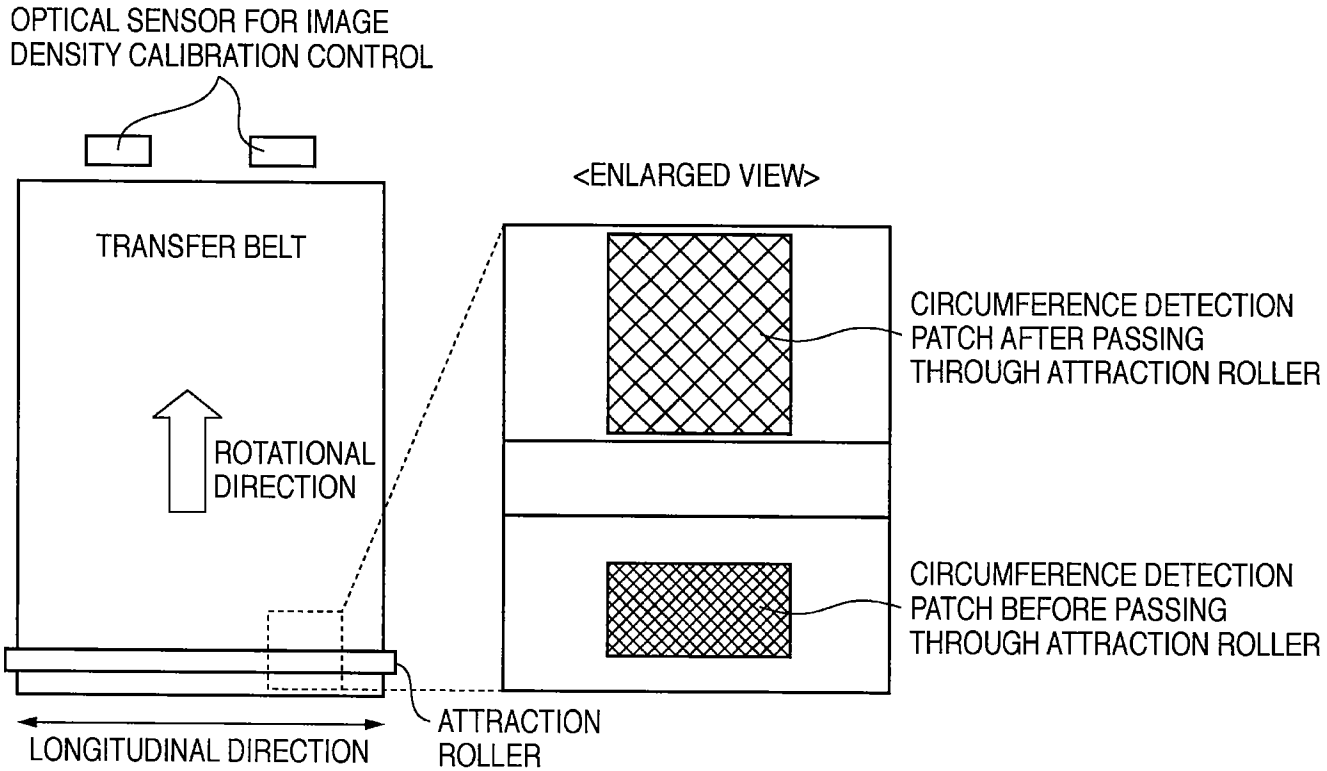
FIG. 18 is a view for explaining a circumference measurement method serving as a comparative example.

As shown in FIG. 18, in comparative example 2, a circumference detection patch is formed on a transfer belt, and is detected by an optical sensor to obtain the circumference of the transfer belt. More specifically, in comparative example 2, the time until a patch is detected after forming it is measured. From the measured time and the circumferential speed of the transfer belt, the circumference of the transfer belt can be attained. The circumference detection patch always passes through the attraction roller before detection.

As represented in Table 2, the circumference measurement result according to the second embodiment reveals that the maximum time taken for circumference detection is shortened by about 4 sec while maintaining the same detection precision as that in comparative example 1. In comparative example 2, circumference detection can start at an arbitrary timing, so the maximum time taken for circumference detection is short, but the detection precision decreases to 0.8 mm. This is because a circumference detection patch always passes through the attraction roller once, as described with reference to FIG. 18, and is smeared by toner scattered by the bias of the attraction roller or by rubbing the patch at the nip of the attraction roller.

To the contrary, the circumference measurement method according to the second embodiment does not form a patch for measuring a circumference. This circumference measurement method can start circumference detection at an arbitrary timing without decreasing the detection precision. Thus, the method shortens the maximum time necessary for circumference detection.

TABLE 2

| | Detection Precision (Max − Min) | Maximum Time Taken For Circumference Detection (sec) |
|---|---|---|
| Comparative Example 1 (Circumference Detection Mark + Circumference Detection Sensor) | 0.4 mm | 8.8 sec |
| Comparative Example 2 (Circumference Is Measured by Printing Patch on Belt) | 0.8 mm | 4.9 sec |
| Circumference Measurement Method of Present Invention (Detection Sensor Also Serves As Density Detection Sensor) | 0.4 mm | 4.9 sec |

As described above, the present invention is also applicable to an image forming apparatus which incorporates a transfer belt serving as a printing material carrier. The second embodiment can achieve the same effects as those of the first embodiment.

<Third Embodiment>

The third embodiment will be explained with reference to FIGS. 19 to 21. The third embodiment employs an image forming apparatus which performs image density calibration control on a photosensitive drum. The control arrangement of the image forming apparatus, the arrangement of the optical sensor, and the algorithms of image density calibration control and circumference measurement are the same as those in the first embodiment, and a description thereof will not be repeated.

[Image Forming Apparatus System]

Figure 19:
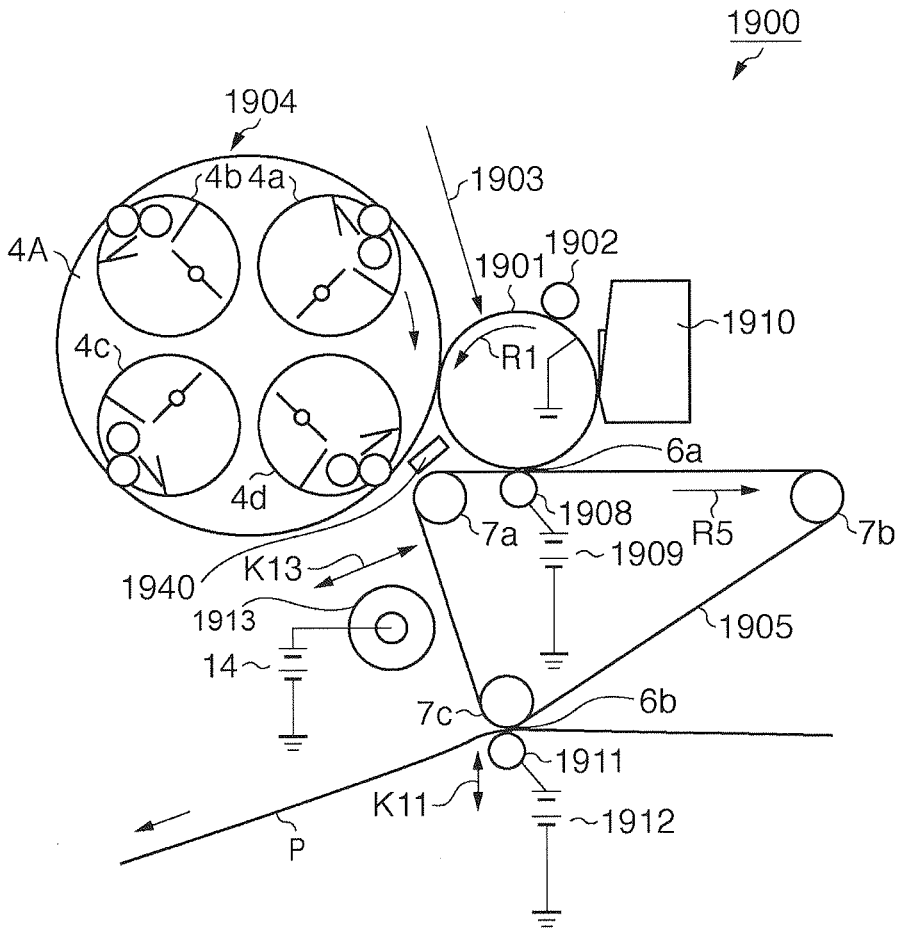
FIG. 19 is a schematic sectional view of a color image forming apparatus according to the third embodiment.

FIG. 19 is a schematic sectional view of a color image forming apparatus according to the third embodiment. A four full-color image forming apparatus 1900 shown in FIG. 19 includes a drum type electrophotographic photosensitive body (to be referred to as a "photosensitive drum" hereinafter) 1901 serving as the first image carrier.

The photosensitive drum 1901 is driven to rotate in the direction of an arrow R1 at a circumferential speed of 120 mm/sec. A charging roller 1902 uniformly charges the surface of the photosensitive drum 1901 to a dark potential VD of −700 V. A laser beam 19030N/OFF-controlled in accordance with the first image information scans and exposes the photosensitive drum 1901 to form the first electrostatic latent image at a bright potential VL of −100 V. A developing device 1904 develops (visualizes) the formed electrostatic latent image. In the developing device 1904, a rotary 4A, which can rotate in the direction of an arrow, incorporates a developing unit 4*a* which stores a yellow toner, a developing unit 4*b* which stores a magenta toner, a developing unit 4*c* which stores a cyan toner, and a developing unit 4*d* which stores a black toner. First, the developing unit 4*a* develops (visualizes) the first electrostatic latent image.

The first visualized toner image is primarily transferred onto the surface of the intermediate transfer belt 1905 electrostatically at a transfer portion 6*a* where the photosensitive drum 1901 faces an intermediate transfer belt 1905 driven to rotate in the direction of an arrow R5. The intermediate transfer belt 1905 is formed as an endless belt from a resin such as PVdF, PET, polycarbonate, polyethylene, or silicone adjusted to a thickness of 50 to 200 μm and a volume resistivity of 10E8 to 10E14 Ω·cm. The intermediate transfer belt 1905 has a circumference slightly longer than the length of a printing material P in the conveyance direction, and is looped between suspension rollers 7*a*, 7*b*, and 7*c*. While the intermediate transfer belt 1905 is pressed against the photosensitive drum 1901 by a primary transfer roller 1908 at a predetermined pressure, it is driven to rotate in the forward direction along the rotational direction of the photosensitive drum 1901 at almost the same circumferential speed as that of the photosensitive drum 1901. When a high-voltage power supply 1909 applies a voltage (primary transfer bias) of a polarity opposite to the charging polarity of toner to the primary transfer roller 1908, a toner image formed on the surface of the photosensitive drum 1901 is primarily transferred onto the surface of the intermediate transfer belt 1905 electrostatically. A cleaner 1910 removes toner (residual primary transfer toner) slightly left on the surface of the photosensitive drum 1901 after the end of primary transfer.

Thereafter, a series of charging, exposure, development, primary transfer, and cleaning described above is repeated sequentially for the remaining three, magenta, cyan, and black other than yellow, primarily transferring toner images sequentially onto the surface of the intermediate transfer belt 1905. In the primary transfer processes of the respective colors, the primary transfer bias applied to the primary transfer roller 1908 may rise sequentially by several to several ten V.

A secondary transfer roller 1911 is arranged to be separable from the surface of the intermediate transfer belt 1905 in the direction of an arrow K11. The secondary transfer roller 1911 which is spaced apart from the surface of the intermediate transfer belt 1905 comes into contact with the surface of the intermediate transfer belt 1905 at a predetermined pressure. Then, the secondary transfer roller 1911 is driven to rotate. A high-voltage power supply 1912 applies, to the secondary transfer roller 1911, a voltage (secondary transfer bias) of a polarity opposite to the charging polarity of toner. The toner images formed on the surface of the intermediate transfer belt 1905 are secondarily transferred at once onto the surface of the printing material P conveyed at a predetermined timing to a second transfer portion 6*b*. The printing material P is conveyed to a fixing unit (not shown) where the image is fixed as a permanent image. Then, the printing material P is discharged from the apparatus main body. A cleaning roller 1913 is arranged to be separable from the surface of the intermediate transfer belt 1905 in the direction of an arrow K13. The cleaning roller 1913 removes toner (residual secondary transfer toner) left on the surface of the intermediate transfer belt 1905 after the end of secondary transfer.

In the image forming apparatus adopted in the third embodiment, the nominal circumference value of the photosensitive drum 1901 is designed to be 400.0 mm. The circumference of the photosensitive drum 1901 does not vary regardless of the use environment condition, but varies depending on the manufacturing tolerance and durability. An optical sensor 1940 for performing image density calibration control is arranged at a position where it faces the photosensitive drum 1901. The third embodiment uses the optical sensor 1940 even for circumference measurement of the photosensitive drum 1901.

Figure 20:
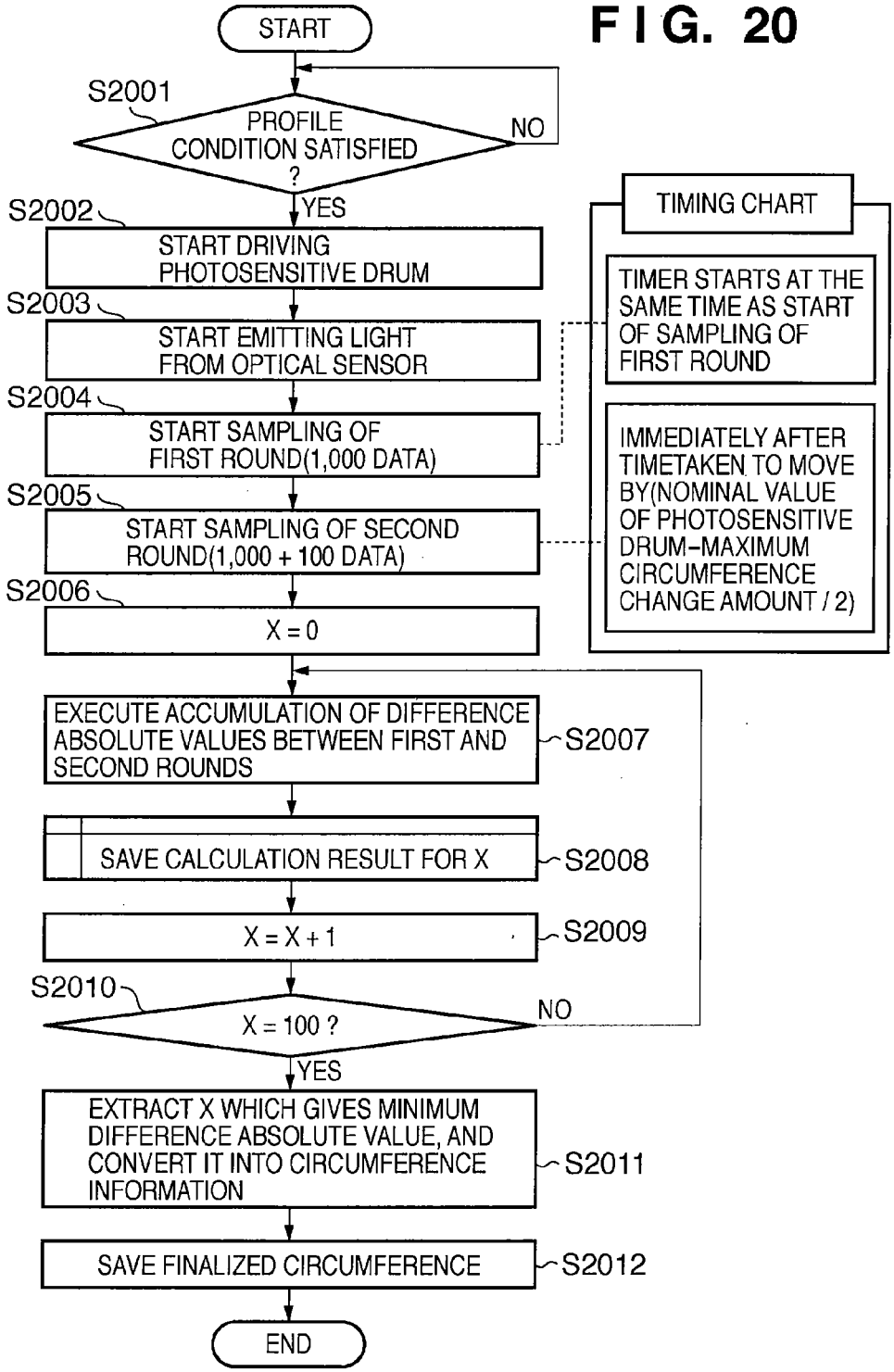
FIG. 20 is a flowchart showing processing to obtain information associated with the actual circumference of a photosensitive drum according to the third embodiment.

FIG. 20 is a flowchart showing processing to cause a CPU 101 to acquire two waveform data and obtain information associated with the actual circumference of the photosensitive drum based on matching between the two waveform data in the third embodiment. Similar to the first embodiment, the CPU 101 executes the flowchart shown in FIG. 20 by loading a control program stored in a ROM 102 into a RAM 103. The first embodiment has exemplified the intermediate transfer belt 31 as a rotation member to undergo circumference detection. The third embodiment will exemplify the photosensitive drum 1901 as a rotation member to undergo circumference detection. Those skilled in the art will understand the flowchart in FIG. 20 even if the photosensitive drum 1901 replaces the circumference detection target in the flowchart of FIG. 9. For this reason, a description of the same processes as those in the flowchart shown in FIG. 9 will not be repeated. More specifically, processes in S2001 and S2003 to S2012 are the same as those in S901 and S903 to S912, and a description thereof will not be repeated.

In step S2002, a circumference measurement unit 111 instructs a driving control unit 108 to drive the target photosensitive drum 1901. Then, driving of the photosensitive drum 1901 starts.

The result of detecting the circumference of the photosensitive drum 1901 by using the circumference measurement method according to the third embodiment will be explained with reference to FIG. 21 and Table 3 in comparison with a result by a circumference measurement method serving as a comparative example. FIG. 21 is a view for explaining a circumference measurement method serving as a comparative example. Table 3 represents the circumference detection precision and the maximum time taken for the circumference detection when the circumference of the photosensitive drum 1901 was detected 50 times by the circumference measurement method according to the third embodiment, and the detection precision and the maximum time taken for the circumference detection by the circumference measurement method serving as a comparative example. A comparative example in Table 3 will be explained with reference to FIG. 21.

Figure 21:
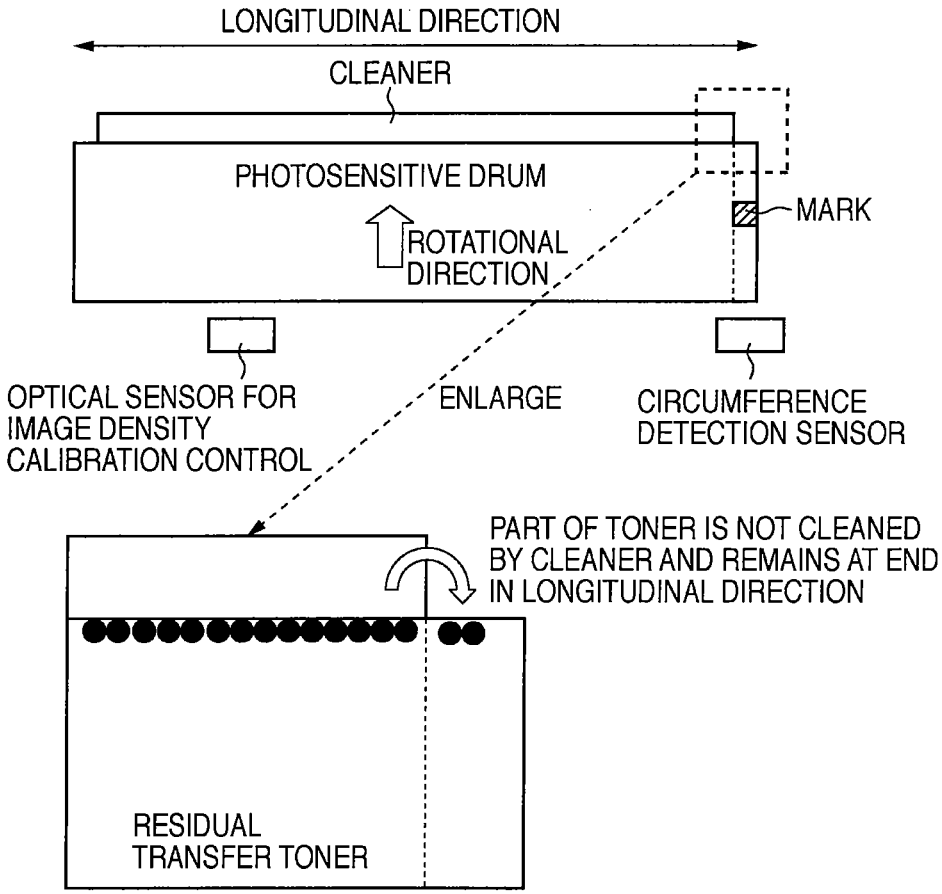
FIG. 21 is a view for explaining a circumference measurement method serving as a comparative example.

The comparative example shown in FIG. 21 uses a circumference detection mark arranged at the end of a photosensitive drum in the longitudinal direction, and a circumference detection sensor for detecting the mark. In the comparative example, the time until the circumference detection sensor detects the mark again after it detects the mark is measured. The circumference is obtained from the circumferential speed of the photosensitive drum. In the comparative example, when a cleaner removes toner left on the photosensitive drum, part of toner is accumulated at an end in the longitudinal direction, resulting in poor detection precision.

In the comparative example, as represented in Table 3, the detection precision is 0.8 mm, and the maximum time taken for circumference detection is 6.7 sec. In the circumference measurement method according to the third embodiment, the optical sensor 1940 is not positioned at an end in the longitudinal direction. Thus, all residual toner is removed, and the detection precision does not decrease, unlike the comparative example. Since circumference detection can be done at an arbitrary timing, the maximum time taken for circumference detection becomes shorter by 2.5 sec than that in the comparative example.

TABLE 3

| | Detection Precision (Max − Min) | Maximum Time Taken For Circumference Detection (sec) |
|---|---|---|
| Comparative Example (Circumference Detection Mark + Circumference Detection Sensor) | 0.8 mm | 6.7 sec |
| Circumference Measurement Method of Present Invention (Detection Sensor Also Serves As Density Detection Sensor) | 0.4 mm | 4.2 sec |

As described above, the circumference measurement method according to the present invention is also applicable to a photosensitive drum serving as an image carrier. The third embodiment can attain the same effects as those of the first embodiment.

<Fourth Embodiment>

In the above-described embodiments, waveform data based on sampling results in the first round of a rotation member are 1,000 data, and those based on sampling results in the second round are 1,100 data. In other words, the detection time of one waveform data acquired based on sampling in the first round is longer than that of the other waveform data acquired based on sampling in the second round. However, the waveform data are not limited to them. For example, the relationship between waveform data may also be reversed from that in the embodiments. That is, the detection time of one waveform data acquired based on sampling in the second round may also be longer than that of the other waveform data acquired based on sampling in the first round.

In this case, calculation of information associated with the actual circumference of a rotation member will be explained mainly for a difference from the first embodiment with reference to FIG. 9 for an intermediate transfer belt 31 serving as a typical example of a rotation member.

Processes corresponding to steps S901 to S903 are executed.

Then, in a process corresponding to step S904, a circumference measurement unit 111 executes sampling of the first round from an arbitrary position for the output value of reflected light received by a light receiving element 302. At the same time as the start of sampling of the first round, the circumference measurement unit 111 activates a timer for determining the sampling start timing of the second round. At this time, the number of sampling points in the first round is 1,100 in correspondence with a shift amount of 100 points, unlike the first embodiment. The fourth embodiment is different from the above-described embodiments in how to adjust a predetermined time from a predetermined reference time necessary for the intermediate transfer belt 31 to rotate one round by using the waveform data detection timing of the first round as a reference. More specifically, a value obtained by adding half the maximum circumference change amount to the nominal circumference is set in the timer.

However, similar to the above-described embodiments, waveform data of the second round is sampled so that the section of the image-formed surface of one of the waveform data of the first and second rounds falls within the section of the image-formed surface corresponding to the other waveform data. Also similar to the above-described embodiments, when the circumference measurement unit 111 acquires two waveform data from a RAM 103, a section of the image-formed surface that corresponds to one waveform data falls within a section of the image-formed surface that corresponds to the other waveform data.

Referring back to the flowchart, if the timer has reached the set value, sampling of the waveform profile of the second round starts in a process corresponding to step S905. At this time, the number of sampling points in the second round is 1,000 points in the fourth embodiment, unlike 1,100 in the first embodiment.

After executing a process corresponding to step S906 similarly to the first embodiment, processes corresponding to steps S907 to S909 continue until YES is determined in a process corresponding to step S910.

At this time, difference absolute values between waveform data (corresponding to the third waveform data) extracted from the waveform profile of the first round and the waveform profile of the second round are accumulated:

$$I(X) = \sum_{i=1}^{1000} |V_{second\ round}(i) - V_{first\ round}(i + X)| \tag{4}$$

Similar to the first embodiment, X=0, 1, 2, . . . , 100.

In a process corresponding to step S911, the circumference measurement unit 111 determines a minimum value among a plurality of calculated accumulated values I (X). The actual circumference can be calculated using an X value which gives a minimum accumulated value:

$$\text{actual circumference}=(100-X_{profile\ result})-X_{ITB\ ideal}))*0.1+\text{nominal circumference} \tag{5}$$

In a process corresponding to step S912, a density calibration control unit 112 of a CPU 101 executes image density calibration control based on information associated with the actual circumference that has been calculated by equation (5).

As described above, even when waveform data corresponding to a long detection time is acquired in sampling of the first round, like the fourth embodiment, the same effects as those of the above-described embodiments can be obtained.

The first to fourth embodiments reveal the following fact. More specifically, two acquired waveform data are defined as the first and second waveform data. One of the waveform data is set as reference waveform data. Waveform data which matches the reference waveform data is extracted from the other waveform data. Interval information corresponding to the interval between the reference waveform data and the extracted waveform data is obtained, attaining information associated with the actual circumference.

<Fifth Embodiment>

In the above-described embodiments, one optical sensor for image density calibration control is used for circumference measurement of a rotation member. However, the present invention is also applicable to an image forming apparatus in which two optical sensors for image density calibration control are arranged along the moving direction of a rotation member.

Figure 22:
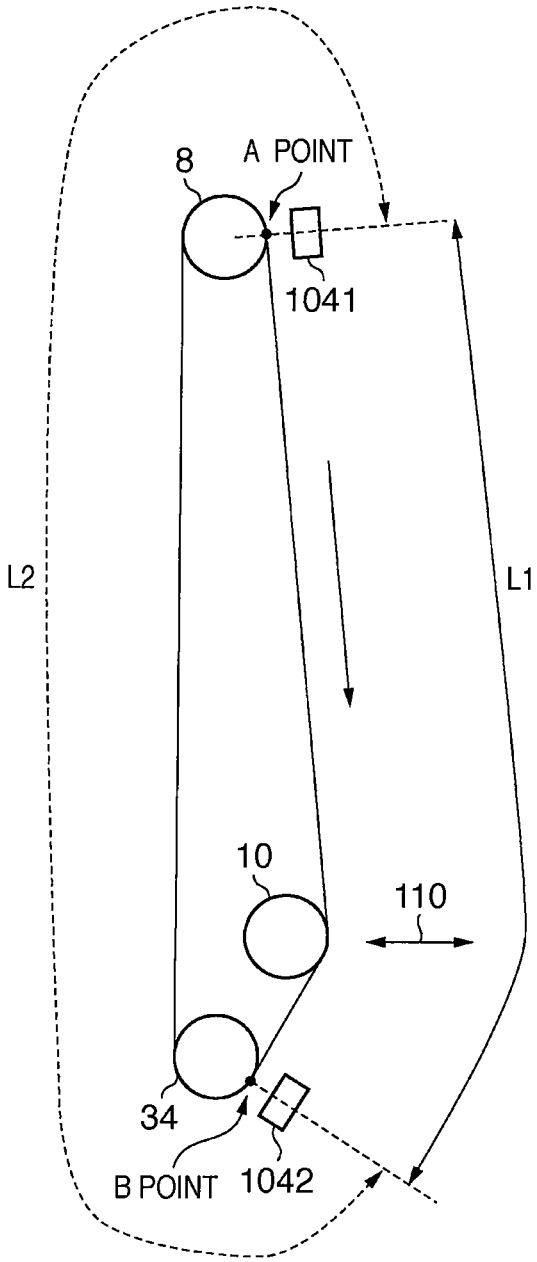
FIG. 22 is a schematic sectional view of an intermediate transfer belt unit according to the fourth embodiment.

When two optical sensors are used, the first optical sensor starts sampling of the waveform profile. Before the rotation member rotates one round, the second optical sensor can start sampling of the second waveform profile. In FIG. 22, the second sampling can be executed after the rotation member moves by L1. This can shorten the circumference measurement time of the rotation member, compared to the above-described embodiments. FIG. 22 shows a concrete example of this.

FIG. 22 is a schematic sectional view of a necessary part of an image forming apparatus that is extracted from FIG. 1. In FIG. 22, a tension roller 10 is movable in accordance with expansion and contraction of an intermediate transfer belt 31 in the direction of an arrow 110 in FIG. 22. Two optical sensors 1041 and 1042 are arranged along the moving direction of the rotation member. These optical sensors have the same mechanism as that of the optical sensor 104 described above.

In FIG. 22, the intermediate transfer belt 31 and a driving roller 8, which are in contact with each other, move apart from each other at point A. The intermediate transfer belt 31 and a roller 34, which are spaced apart from each other, come into contact with each other at point B.

Points A and B are the measurement points of the optical sensors 1041 and 1042.

L1 represents a length between points A and B along the intermediate transfer belt 31 via the tension roller 10 when the intermediate transfer belt 31 neither expands nor contracts. L2 represents the remaining length.

When the optical sensor 1041 starts sampling at an arbitrary timing, it starts sampling at 1,000 points according to equation (2) in the first embodiment.

In FIG. 9, the second sampling start timing is determined from a timer value obtained by subtracting half the maximum circumference change amount from the nominal circumference. To the contrary, when two optical sensors are arranged at the interval L1, the second sampling start timing suffices to be set based on a value obtained by subtracting half the maximum circumference change amount from the nominal interval L1. The second sampling is executed at 1,100 points.

The same processes as those in steps S907 to S911 in FIG. 9 are performed for a waveform profile obtained by the first sampling by the optical sensor 1041 and a waveform profile obtained by the optical sensor 1042. Accordingly, X corresponding to the minimum accumulated value I can be extracted. Similar to the first embodiment, information associated with the actual circumference can be calculated in accordance with equation (3). The minimum accumulated value I is calculated by $$I(X) = \sum_{i=1}^{1000} |V_{1041}(i) - V_{1042}(i + X)| \tag{6}$$

The fifth embodiment is different from the first embodiment in that sampling in the first round corresponds to sampling by the optical sensor 1041, and sampling in the second round corresponds to sampling by the optical sensor 1042.

Even the mechanism described with reference to FIG. 22 can also calculate information associated with the actual circumference of the intermediate transfer belt 31 serving as a rotation member. Information associated with the actual circumference of the rotation member can be obtained earlier than in the first to third embodiments. In addition to the same effects as those of the first to third embodiments, the fifth embodiment can provide an additional effect capable of shortening the downtime to the user.

It will be obvious to those skilled in the art that the above-described mechanism is also applicable to FIGS. 17 and 20, and a detailed description thereof will be omitted.

<Sixth Embodiment>

The present invention is not limited to the above-described embodiments, and can be variously modified. For example, the first to third embodiments execute circumference measurement using an optical sensor for density calibration control. However, the present invention may measure the circumference of a rotation member using a color misregistration detection sensor as an optical sensor for circumference measurement. The circumference is measured using specularly reflected light. However, depending on the type of rotation member to be measured, the circumference may also be measured using diffusely reflected light. The waveform profile is calculated by accumulating difference absolute values. Instead, the circumference of a rotation member may also be obtained by calculating a standard deviation. The measured circumference of a rotation member is used for image density calibration control in the above-described embodiments, but may also be used for color misregistration calibration control.

More specifically, a case wherein a circumference measurement unit 111 performs calculation based on a standard deviation will be explained by exemplifying the first embodiment. An equation at this time is $$\sigma = \frac{xi = V_{first\ round}(i) - V_{second\ round}(i+X)}{\sqrt{\dfrac{n\sum (V_{first\ round}(i) - V_{second\ round}(i+X))^2 - (\sum (V_{first\ round}(i) - V_{second\ round}(i+X)))^2}{n(n-1)}}} \tag{7}$$

where n is the number of samples, and σ is the standard deviation value. Since the number Xi of samples=1,000, n=1,000. The remaining variables have been explained in the first embodiment.

For X=0, 1, 2, . . . , 100, X which gives a minimum σ is extracted. After extracting X, information associated with the actual circumference is obtained similarly to the first embodiment. It will readily occur to those skilled in the art to apply equation (7) employing the standard deviation to the second to fourth embodiments.

<Seventh Embodiment>

In the above-described embodiments (particularly in the first and fourth embodiments), when obtaining information associated with the actual circumference of a rotation member, the other waveform data (second waveform data) containing at least part of one waveform data (first waveform data) is acquired. In other words, the surface of a rotation member is detected. Then, the other waveform data (second waveform data) for detecting at least part of the detection section of one waveform data (first waveform data) is acquired. From this, information associated with the actual circumference is obtained. The seventh embodiment will be explained below as a modification to the above-described embodiments.

Assume that 1,000 data are detected and acquired in, for example, 0.1-mm cycles in background sampling of the first round, similar to the above-described embodiments. In the seventh embodiment, 1,000 data may also be detected and acquired in 0.1-mm cycles in even background sampling of the second round. In this case, when obtaining an actual circumference, I(X) is defined as $$I(X) = \sum_{i=1}^{1000-X} \{V_{first\ round}(i) - V_{second\ round}(i+X)\} \tag{8}$$

A circumference measurement unit 111 calculates the accumulated values I(X) for all X from X=0 to X=100. The circumference measurement unit 111 determines a minimum value among the calculated accumulated values I(X). Further, the circumference measurement unit 111 extracts X which gives a minimum I(X), and calculates an actual circumference:

$$\text{actual circumference}=(X-50)*0.1+\text{nominal circumference (mm)} \tag{9}$$

Figure 23:
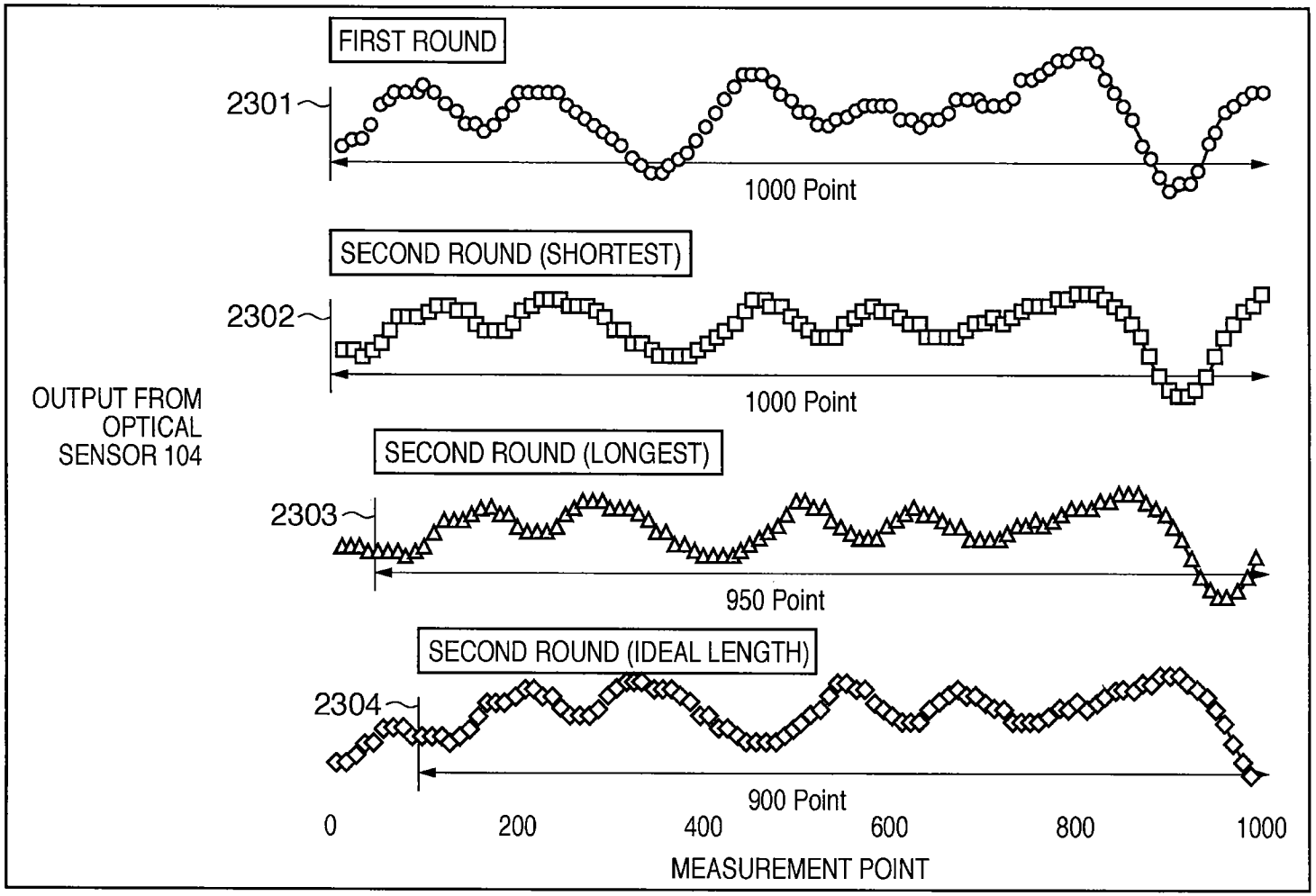
FIG. 23 is a graph showing an example of waveform data according to the seventh embodiment.

FIG. 23 shows an acquisition result 2301 (FIG. 23) of waveform data of the first round, and acquisition results 2302, 2303, and 2304 (FIG. 23) of waveform data of the second round. The waveform data of the first and second rounds shown in FIG. 23 are detected by an optical sensor 104, stored in a RAM 103, and acquired, similar to the above-described embodiments.

The acquisition result 2302 of FIG. 23 corresponds to a case assumed by the present applicant in which the actual circumference of a rotation member is the shortest. The acquisition result 2303 corresponds to a case wherein the actual circumference of the rotation member has a nominal value. The acquisition result 2304 corresponds to a case wherein the actual circumference of the rotation member is the longest.

As shown in FIG. 23, when the actual circumference of the rotation member is shorter than the nominal one, X which gives a minimum I(X) takes a value close to 0. When the actual circumference of the rotation member is equal to the nominal one, X which gives a minimum I(X) is 50. When the actual circumference of the rotation member is longer than the nominal one, X which gives a minimum I(X) takes a value close to 100.

Even the calculation method described with reference to FIG. 23 can obtain the actual circumference of a rotation member at high precision using X which gives a minimum I(X).

As another calculation method, a circumference measurement unit 111 can also obtain an actual circumference at high precision according to the above-mentioned equation based on a standard deviation:

$$xi=V_{first\ round}(i)-V_{second\ round}(i+X) \tag{10}$$

$$\sigma(X) = \sqrt{\frac{n\sum_{i=1}^{1000-X}(V_{first\ round}(i) - V_{second\ round}(i+X))^2 - \left(\sum_{i=1}^{1000-X}(V_{first\ round}(i) - V_{second\ round}(i+X))\right)^2}{n(n-1)}}$$

According to equation (10), the circumference measurement unit 111 calculates standard deviations σ(X) when X changes from X=0 to X=100. The circumference measurement unit 111 attains X which gives a minimum σ(X), and calculates an actual circumference in accordance with equation (9).

The number Xi of samples changes from 1,000 to 900 for X=0 to X=100. By using X which gives a minimum σ(X), the actual circumference can be obtained at high precision.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-138780 filed May 27, 2008 and Japanese Patent Application No. 2009-103362 filed Apr. 21, 2009, which are hereby incorporated by reference herein in their entirety.

What is claimed is:

1. An image forming apparatus having a rotation member which is used for image formation or carrying a printing material, and a detector which detects light coming from the rotation member, the apparatus comprising:

a first acquisition unit that acquires first waveform data of a surface of the rotation member based on detection by the detector;

a second acquisition unit that acquires second waveform data of the surface of the rotation member based on detection by the detector, the second waveform data being detected from at least part of a detected section of the surface of the rotation member on which the first waveform data has been detected; and a calculator that calculates information associated with a circumference of the rotation member based on matching between the acquired first waveform data and second waveform data, and information associated with the circumference of the rotation member before acquiring the first waveform data and the second waveform data.

2. The apparatus according to claim 1, wherein the surface of the rotation member is an image-forming surface used for image formation.

3. The apparatus according to claim 1, wherein said calculator includes an extraction unit that sets one of the first waveform data and the second waveform data as reference waveform data, and extracts, from the other waveform data, waveform data determined to match the reference waveform data in matching processing, and as the information associated with the circumference of the rotation member, said calculator calculates interval information corresponding to an interval between the reference waveform data and the waveform data extracted by said extraction unit.

4. The apparatus according to claim 3, wherein the interval information corresponding to the interval between the reference waveform data and the extracted waveform data represents a shift of the waveform data extracted by said extraction unit from a predetermined reference.

5. The apparatus according to claim 1, wherein said calculator includes an extraction unit that sets one of the first waveform data and the second waveform data as waveform data corresponding to a longer detection time than a detection time of the other waveform data, and extracts third waveform data which matches the other waveform data among a plurality of third waveform data obtained by shifting the one waveform data by different shift amounts with a length equal to a length of the other waveform data, and said calculator calculates the information associated with the circumference of the rotation member based on a shift amount of the third waveform data extracted by said extraction unit.

6. The apparatus according to claim 5, wherein said extraction unit calculates, for a plurality of third waveform data, accumulated values of difference absolute values between values which form the first waveform data and values which form the third waveform data, and extracts third waveform data corresponding to a minimum accumulated value among the plurality of calculated accumulated values.

7. The apparatus according to claim 1, wherein the first waveform data and the second waveform data correspond to sampling of a section of part of the surface of the rotation member, and one of the first waveform data and the second waveform data corresponds to sampling of a longer section than a section of the other waveform data.

8. The apparatus according to claim 1, wherein the second waveform data is detected at a timing adjusted by a predetermined time from a predetermined reference time necessary for the rotation member to rotate one round from a detection timing of the first waveform data serving as a reference so as to contain a section of the surface of the rotation member of one of the first waveform data and the second waveform data within a section of the surface of the rotation member corresponding to the other waveform data.

9. The apparatus according to claim 1, further comprising:

a patch image forming unit that forms a patch image on the rotation member to perform density calibration control in image formation; and a setting unit that sets an image forming condition, wherein said setting unit adjusts the image forming condition based on a detection result of a quantity of light coming from the patch image by the detector and the calculated information associated with the circumference of the rotation member.

10. The apparatus according to claim 1, wherein the rotation member includes one of a photosensitive body and an intermediate transfer member serving as image carriers, and a transfer member serving as a printing material carrier.

11. The apparatus according to claim 1, wherein the detection of the second waveform data is started before one rotation occurred by the rotation member from starting the detection of the first waveform data.

12. The apparatus according to claim 1, wherein the detection of the second waveform data is terminated after one rotation occurred by the rotation member from terminating the detection of the first waveform data.

13. The apparatus according to claim 1, wherein the detection of the second waveform data is started before one rotation occurred by the rotation member from starting the detection of the first waveform data, and the detection of the second waveform data is terminated after one rotation occurred by the rotation member from terminating the detection of the first waveform data.

14. The apparatus according to claim 1, the detection of the second waveform data is started after one rotation occurred by the rotation member from starting the detection of the first waveform data, and the detection of the second waveform data is terminated before one rotation occurred by the rotation member from terminating the detection of the first waveform data.

15. The apparatus according to claim 1, wherein the detector detects a state of the surface of the rotation member on which there is no image.

16. The apparatus according to claim 15, wherein unevenness is detected as the state of the surface of the rotation member.

17. An image forming apparatus having a rotation member which is used for image formation or carrying a printing material, a detector which detects light coming from the rotation member, and a patch forming unit that forms a patch on the rotation member, the detector detecting reflected light upon irradiating the patch with light, the apparatus comprising:

a first acquisition unit that acquires first waveform data of a surface of the rotation member based on detection by the detector; and a second acquisition unit that acquires second waveform data of the surface of the rotation member based on detection by the detector, the second waveform data being detected from at least part of a detected section of the surface of the rotation member on which the first waveform data has been detected, wherein density is detected based on matching between the acquired first waveform data and second waveform data, and the reflected light detected by the detector.

18. A method of controlling an image forming apparatus having a rotation member which is used for image formation or carrying a printing material, and a detector which detects light coming from the rotation member, the method comprising the steps of:

acquiring first waveform data of a surface of the rotation member based on detection by the detector;

acquiring second waveform data of the surface of the rotation member based on detection by the detector, the second waveform data being detected from at least part of a detected section of the surface of the rotation member on which the first waveform data has been detected; and calculating information associated with a circumference of the rotation member based on matching between the acquired first waveform data and second waveform data, and information associated with the circumference of the rotation member before acquiring the first waveform data and the second waveform data.

19. A method of controlling an image forming apparatus having a rotation member which is used for image formation or carrying a printing material, a detector which detects light coming from the rotation member, and a patch forming unit that forms a patch on the rotation member, the detector detecting reflected light when the patch is irradiated with light, the method comprising the steps of:

acquiring first waveform data of a surface of the rotation member based on detection by the detector; and acquiring second waveform data of the surface of the rotation member based on detection by the detector, the second waveform data being detected from at least part of a detected section of the surface of the rotation member on which the first waveform data has been detected, wherein density is detected based on matching between the acquired first waveform data and second waveform data, and the reflected light detected by the detector.

20. An image forming apparatus having a rotation member which is used for image formation or carrying a printing material, and a detector which detects light coming from the rotation member, the apparatus comprising:

a first acquisition unit that acquires first waveform data of a surface of the rotation member based on detection by the detector;

a second acquisition unit that acquires second waveform data of the surface of the rotation member based on detection by the detector, the second waveform data being detected from at least part of a detected section of the surface of the rotation member on which the first waveform data has been detected; and a calculator that calculates information associated with a circumference of the rotation member based on matching between the acquired first waveform data and second waveform data, wherein the detection of the second waveform data is started before one rotation occurred by the rotation member from starting the detection of the first waveform data.

21. An image forming apparatus having a rotation member which is used for image formation or carrying a printing material, and a detector which detects light coming from the rotation member, the apparatus comprising:

a first acquisition unit that acquires first waveform data of a surface of the rotation member based on detection by the detector;

a second acquisition unit that acquires second waveform data of the surface of the rotation member based on detection by the detector, the second waveform data being detected from at least part of a detected section of the surface of the rotation member on which the first waveform data has been detected; and a calculator that calculates information associated with a circumference of the rotation member based on matching between the acquired first waveform data and second waveform data, wherein the detection of the second waveform data is terminated after one rotation occurred by the rotation member from terminating the detection of the first waveform data.

22. An image forming apparatus having a rotation member which is used for image formation or carrying a printing material, and a detector which detects light coming from the rotation member, the apparatus comprising:

a first acquisition unit that acquires first waveform data of a surface of the rotation member based on detection by the detector;

a second acquisition unit that acquires second waveform data of the surface of the rotation member based on detection by the detector, the second waveform data being detected from at least part of a detected section of the surface of the rotation member on which the first waveform data has been detected; and a calculator that calculates information associated with a circumference of the rotation member based on matching between the acquired first waveform data and second waveform data, wherein the detection of the second waveform data is started before one rotation occurred by the rotation member from starting the detection of the first waveform data, and the detection of the second waveform data is terminated after one rotation occurred by the rotation member from terminating the detection of the first waveform data.

23. An image forming apparatus having a rotation member which is used for image formation or carrying a printing material, and a detector which detects light coming from the rotation member, the apparatus comprising:

a first acquisition unit that acquires first waveform data of a surface of the rotation member based on detection by the detector;

a second acquisition unit that acquires second waveform data of the surface of the rotation member based on detection by the detector, the second waveform data being detected from at least part of a detected section of the surface of the rotation member on which the first waveform data has been detected; and a calculator that calculates information associated with a circumference of the rotation member based on matching between the acquired first waveform data and second waveform data, wherein the detection of the second waveform data is started after one rotation has occurred by the rotation member from starting the detection of the first waveform data, and the detection of the second waveform data is terminated before one rotation has occurred by the rotation member from terminating the detection of the first waveform data.

24. An image forming apparatus having a rotation member which is used for image formation or carrying a printing material, and a detector which detects light coming from the rotation member, the apparatus comprising:

a first acquisition unit that acquires first waveform data of a surface of the rotation member based on detection by the detector;

a second acquisition unit that acquires second waveform data of the surface of the rotation member based on detection by the detector, the second waveform data being detected from at least part of a detected section of the surface of the rotation member on which the first waveform data has been detected; and a calculator that calculates information associated with a circumference of the rotation member based on matching between the acquired first waveform data and second waveform data, wherein the detector detects a state of the surface of the rotation member on which there is no image.

25. The apparatus according to claim 24, wherein unevenness is detected as the state of the surface of the rotation member.

* * * * *